US012691357B2

(12) United States Patent
Amanatidis et al.

(10) Patent No.: US 12,691,357 B2
(45) Date of Patent: Jul. 28, 2026

(54) LOWER EXTREMITY COMBAT TRAINING DEVICE

(71) Applicant: The Blacksmith Brand LLC, Tempe, AZ (US)

(72) Inventors: Petros Amanatidis, Tempe, AZ (US); Bastien Jourde, Montreal (CA); Benoit Labelle, Blainville (CA)

(73) Assignee: The Blacksmith Brand LLC, Tempe, AZ (US)

( * ) Notice: Subject to any disclaimer, the term of this patent is extended or adjusted under 35 U.S.C. 154(b) by 0 days.

(21) Appl. No.: 18/823,898

(22) Filed: Sep. 4, 2024

(65) Prior Publication Data

US 2026/0061294 A1 Mar. 5, 2026

(51) Int. Cl.
*A63B 71/12* (2006.01)

(52) U.S. Cl.
CPC .... *A63B 71/1225* (2013.01); *A63B 2071/125* (2013.01); *A63B 2071/1258* (2013.01); *A63B 2071/1275* (2013.01); *A63B 2071/1283* (2013.01); *A63B 2244/10* (2013.01)

(58) Field of Classification Search
CPC ..... A63B 71/1225; A63B 2071/125; A63B 2071/1258; A63B 2071/1275; A63B 2071/1283; A63B 2244/10; A63B 69/26; A41D 13/00; A41D 13/0543
See application file for complete search history.

(56) References Cited

U.S. PATENT DOCUMENTS

| | | | | |
|---|---|---|---|---|
| 4,756,026 | A * | 7/1988 | Pierce, Jr. | A63B 71/1225 2/24 |
| 4,888,826 | A * | 12/1989 | Parsons, Jr. | A63B 71/1225 2/22 |
| 5,301,370 | A * | 4/1994 | Henson | A63B 71/1225 2/24 |
| 6,065,152 | A * | 5/2000 | Parker | A63B 71/1225 2/22 |
| 8,256,034 | B2 * | 9/2012 | Berner, Jr. | A41D 31/185 2/455 |
| 9,643,053 | B2 * | 5/2017 | Guiney | A63B 27/00 |
| 9,656,149 | B2 * | 5/2017 | Hughes | A41D 13/015 |
| 2003/0167548 | A1 * | 9/2003 | LaShoto | A41D 13/0556 2/22 |

(Continued)

OTHER PUBLICATIONS

International Search Report and Written Opinion for International Patent Application No. PCT/US2025/044811 dated Oct. 15, 2025, 14 pages.

*Primary Examiner* — Alissa L Hoey
*Assistant Examiner* — Akwokwo Olabisi Redhead
(74) *Attorney, Agent, or Firm* — Hahn Loeser & Parks LLP

(57) ABSTRACT

The present disclosure is for a lower extremity combat training device. The lower extremity combat training device has a shin guard, a knee guard, and a dorsum guard. The knee guard is an extension of the shin guard. A padded medial side and a padded lateral side extend into the knee guard and are, additionally, a medial side of the knee guard and a lateral side of the knee guard, respectively. The knee guard remains aligned with and moves with the shin guard. The knee guard further has a padded knee cavity secured between the medial side of the knee guard and the lateral side of the knee guard. The dorsum guard is adhered to the shin guard and extends from a bottom side of the shin guard.

19 Claims, 21 Drawing Sheets

(56) References Cited

U.S. PATENT DOCUMENTS

| | | | | |
|---|---|---|---|---|
| 2006/0107433 | A1* | 5/2006 | Olson | A63B 71/08 2/22 |
| 2007/0250977 | A1* | 11/2007 | Brown | A41D 13/0543 2/22 |
| 2008/0120756 | A1* | 5/2008 | Shepherd | A41D 13/0568 2/22 |
| 2008/0178360 | A1* | 7/2008 | Nascimento | A63B 71/1225 2/22 |
| 2008/0201814 | A1* | 8/2008 | Goyer | A63B 71/1225 2/22 |
| 2020/0391096 | A1* | 12/2020 | Gauvin | A41D 13/0543 |
| 2023/0053749 | A1* | 2/2023 | Long | A41D 13/065 |

* cited by examiner

LOWER EXTREMITY COMBAT TRAINING DEVICE

TECHNICAL FIELD

This disclosure relates to training equipment for combat environments or combat sports. More specifically, the present disclosure relates to a lower extremity protective, or training, device for use in training for combat environments or combat sports.

BACKGROUND

Training is an important aspect of any field that requires acquired skill. This is especially important in fields that pose the risk of severe injury or death. To avoid undue injury or death, protective devices are commonplace for training activities. Protective devices used in training may additionally, or alternatively, be referred to herein as training devices.

Professionals in the military, law enforcement, protective service, and similar fields undergo training that is intended to mimic actual hand-to-hand combat. The training, however, is not intended to rise to the level of risk of death or severe injury that might be present in actual combat. Instead, the training is intended to prepare the professionals for actual combat by mimicking actual combat, as much as possible, under reduced risk. Accordingly, combat training requires protective devices that are not otherwise utilized in actual combat. The cumbersome nature of the protective devices, however, may present an impediment to development of the proper skills for actual combat and may negatively impact the readiness of such professionals.

Likewise, athletes of all levels (e.g., professional, amateur, hobbyist, etc.) in hand-to-hand combat activities, sports, or fitness also undergo training that is intended to mimic actual hand-to-hand combat. Such activities may include martial arts, judo, jiu-jitsu, kickboxing, karate, mixed martial arts, boxing, or the like. In these activities, crippling or damaging strikes to the body and extremities are commonplace. The training, however, is not intended to rise to the level of severe injury or risk of death that might arise in a fully competitive event. Many athletes train for months, and even years, to prepare themselves for a single competitive event. In contrast, some athletes may train for fitness, as a hobby, and/or for camaraderie, but with no actual intent of engaging in a fully competitive event. Regardless of the reason for training, a professional or athlete does not wish to compromise their physical health, life, or ability to engage in the actual competitive event due to training activities. Therefore, training for such activities requires the use of protective devices that are not otherwise utilized in actual competition. Again, the cumbersome nature of protective devices, however, may present an impediment to the development of the proper skills for actual competition and may negatively impact the readiness of such athletes.

Individuals training for combative environments, regardless of whether they are military, law enforcement, professional, amateur, or just a hobbyist, are generally referred to herein as practitioners. Practitioners undertake training activities to improve their skills and learn new skills. Practitioners desire the knowledge to know their training is effective and their skills are adequate for the intended environment, to avoid or defend against unnecessary injury or even death in the combative environments. While practitioners desire to train in environments as close as possible to the actual combative environments, practitioners do not wish to injure or harm themselves or their training partners. Otherwise, their efforts would be counterproductive and the opportunity for improvement would be stifled by injury or even death. Therefore, while protective devices are not utilized in the actual combative environments, protective devices are commonplace when training.

Protective devices currently in the marketplace are prone to failure and are not designed for optimum protection with limited interference. Specifically, shin pads are often worn below the knees in training and do not protect joints. Such shin pads have limitations. By example, the protection provided by such shin pads are limited to the front of the leg with no protection afforded for knees, ankle joints, or the calf region. Further, shin pads are secured to the leg by straps that are prone to slipping and failure. Should a practitioner wish to further protect their knees or other joints, additional protective devices must be added and independently worn. These additional protective devices, however, often conflict with the shin pad, forcing one or the other out of position, giving rise to risk for injury or failure of the device. Additionally, wearing multiple protective devices becomes restrictive to the practitioner. The practitioner, therefore, must adapt to the protective device and is no longer training for actual combative environments. Specifically, the practitioner, must adapt their training to accommodate the restrictive nature of independently operating protective devices.

In view of this, what is needed is a protective device for lower extremities that operates as a combined shin guard, foot guard, ankle guard, knee guard, calf region guard, and/or Achilles guard, while reducing any limitation to the movements of the practitioner or detracting from the feeling of the true combative environment. What is needed is a protective device that may be modified as a singular device with a selection of the desired combination of protective features for one or more of the above-mentioned body regions, based on the intended combat activity or practitioner's preference. What is needed is a protective device that operates in unison across these body regions, where protection is afforded to multiple regions without compromising protection at adjoining regions. What is also needed is a protective device that possesses adjustable, removable, and replaceable components to adapt to the practitioner's size and usage, without requiring full replacement of the device or the utilization of multiple devices.

SUMMARY

The present disclosure relates to training equipment for combat environments or combat sports. More specifically, the present disclosure relates to a lower extremity training device for use in training for combat environments or combat sports.

A lower extremity combat training device of the present disclosure may comprise a shin guard, a knee guard, and a dorsum guard. The shin guard may comprise a front and a back. A centrally positioned pad may extend from the front. The centrally positioned pad may be a centrally positioned raised pad. A padded medial side and a padded lateral side may extend from the centrally positioned pad. The padded medial side and the padded lateral side may further extend about the back wherein the back of the shin guard is concave. The knee guard may be an extension of the shin guard above the centrally positioned pad. The padded medial side is additionally a medial side of the knee guard. The padded lateral side is additionally a lateral side of the knee guard. The medial side of the knee guard and the lateral side of the knee guard remain aligned with and move with the shin guard. The knee guard may further comprise a padded knee cavity secured between the medial side of the knee guard and the lateral side of the knee guard. A dorsum guard may be adhered to the back of the shin guard below the centrally positioned pad. The dorsum guard may be capable of moving in a plane different than the plane of the shin guard. The back of the dorsum guard may be concave.

In examples of the lower extremity combat training device the medial side of the knee guard and the lateral side of the knee guard may be more rigid than the padded knee cavity. The padded knee cavity may encapsulate a flexible pad. The flexible pad may comprise one or more serrations extending from a top side of the flexible pad. The flexible pad may float freely within the padded knee cavity. In other words, the flexible pad is not adhered to a material of the padded knee cavity. A top of the padded knee cavity may comprise a curvature extending about and overtop the back of the shin guard. The back of the padded knee cavity may be a different material than the back of the shin guard. By example, the back of the padded knee cavity may be a mesh.

In examples, the knee guard does not have a strap extending therefrom. While the lower extremity combat training device may comprise one or more straps, the one or more straps of the combat training device are below the knee guard, such as, for example, adjacent to or extending from the shin guard. In examples, all of the one or more straps are below the knee guard.

In an alternative example, the knee guard may comprise one or more straps, in addition to the shin guard straps, should that be a user's preference. The knee guard strap may be similar to and parallel to the shin guard straps, at the knee guard. The knee guard strap may be removable and/or adjustable as described with respect to the strap of the dorsum guard. Corresponding apertures may be provided in the shin guard for such, such as, for example as described and illustrated with respect to the dorsum guard and/or Achilles guard, below. Alternatively, the knee guard strap may be rigid, and a direct extension of the knee guard as described with respect to the shin guard straps.

In examples, the centrally positioned pad may be more rigid than the padded medial side and the padded lateral side. In some examples, the padded lateral side comprises more padding than the padded medial side. Additionally, or alternatively, the padded lateral side may be larger than the padded medial side. Accordingly, the lower extremity combat training device may be asymmetrical about a central axis extending from the knee guard to the dorsum guard. More specifically, one or more, each, or any combination of shin guard, knee guard, and dorsum guard may be asymmetrical about a central axis extending from the knee guard to the dorsum guard. In examples, a comfort strip may be provided such that the conform strip interrupts the concavity of the back of the shin guard.

In examples, the lower extremity combat training device may further comprise an Achilles guard. The Achilles guard may be a padded partial loop extending from the back of the shin guard from the padded medial side to the padded lateral side. The Achilles guard may be removable. In examples, the Achilles guard may additionally extend into the calf region of a lower extremity. In some examples, the Achilles guard may widen or extend downwardly for additional heel protection. Additionally or alternatively, the Achilles guard may extend upwardly for additional calf protection.

In examples, the dorsum guard may comprise a strap extending across the back of the dorsum guard. The strap of the dorsum guard may be removable. The strap of the dorsum may be adjustable in length. Additionally, or alternatively, the strap of the dorsum guard may be adjustable in a direction along a central axis extending from the knee guard to the dorsum guard. By example, the strap of the dorsum guard may be adjustable in length and adjustable in a direction along a central axis extending from the knee guard to the dorsum guard. The dorsum guard may adhere to the shin guard by a padded fabric. In examples, the dorsum guard adhered to the shin guard provides additional padding to the back of the shin guard. The padded fabric may be adhered between the shin guard and the dorsum guard by a hook and loop arrangement. The padded fabric may comprise a pattern of raised silicon protrusions. In examples, the back of one or more of, each, or any combination of the shin guard, the knee guard, the dorsum guard, and the Achilles guard may comprise a pattern of raised silicon protrusions.

The foregoing and other objects, features, and advantages of the examples will be apparent from the following more detailed descriptions of particular examples as illustrated in the accompanying drawings wherein like reference numbers represent like parts of the examples.

BRIEF DESCRIPTION OF THE DRAWINGS

Reference is made to the accompanying drawings in which particular examples and further benefits of the examples are illustrated as described in more detail in the description below, in which.

DETAILED DESCRIPTION

The present disclosure is of a combat training device. More specifically, the present disclosure is of a lower extremity combat training device. A lower extremity, as used herein, includes portions of a leg extending from the hip through the foot. The lower extremity combat training device of the present disclosure sets out to protect critical areas of the lower extremities not otherwise protected by shin guards. The critical areas include critical bone structures, critical muscle structures, critical ligaments, and critical joints of the lower extremities. The lower extremity combat training device of the present disclosure sets out to protect these critical areas in training activities to avoid injury during training activities. The lower extremity combat training device of the present disclosure sets out to protect these critical areas with very limited impediment to the movement of the lower extremities in training, thereby, properly preparing a practitioner for combat usage when the lower extremity combat training device is not being utilized.

Figure 1:
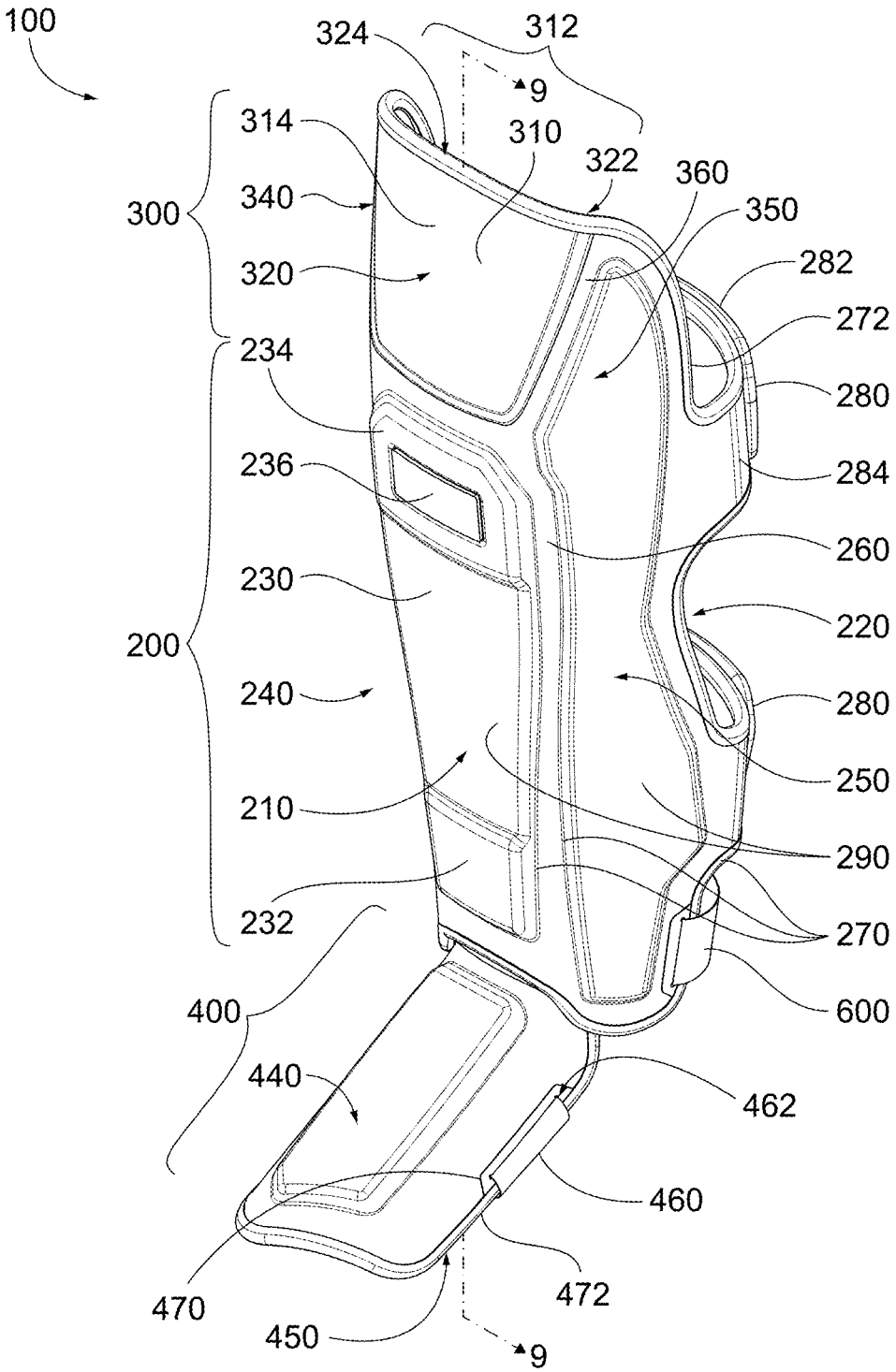
FIG. 1 is a front perspective view of a lower extremity combat training device, in accordance with an example of the disclosure.
Figure 2:
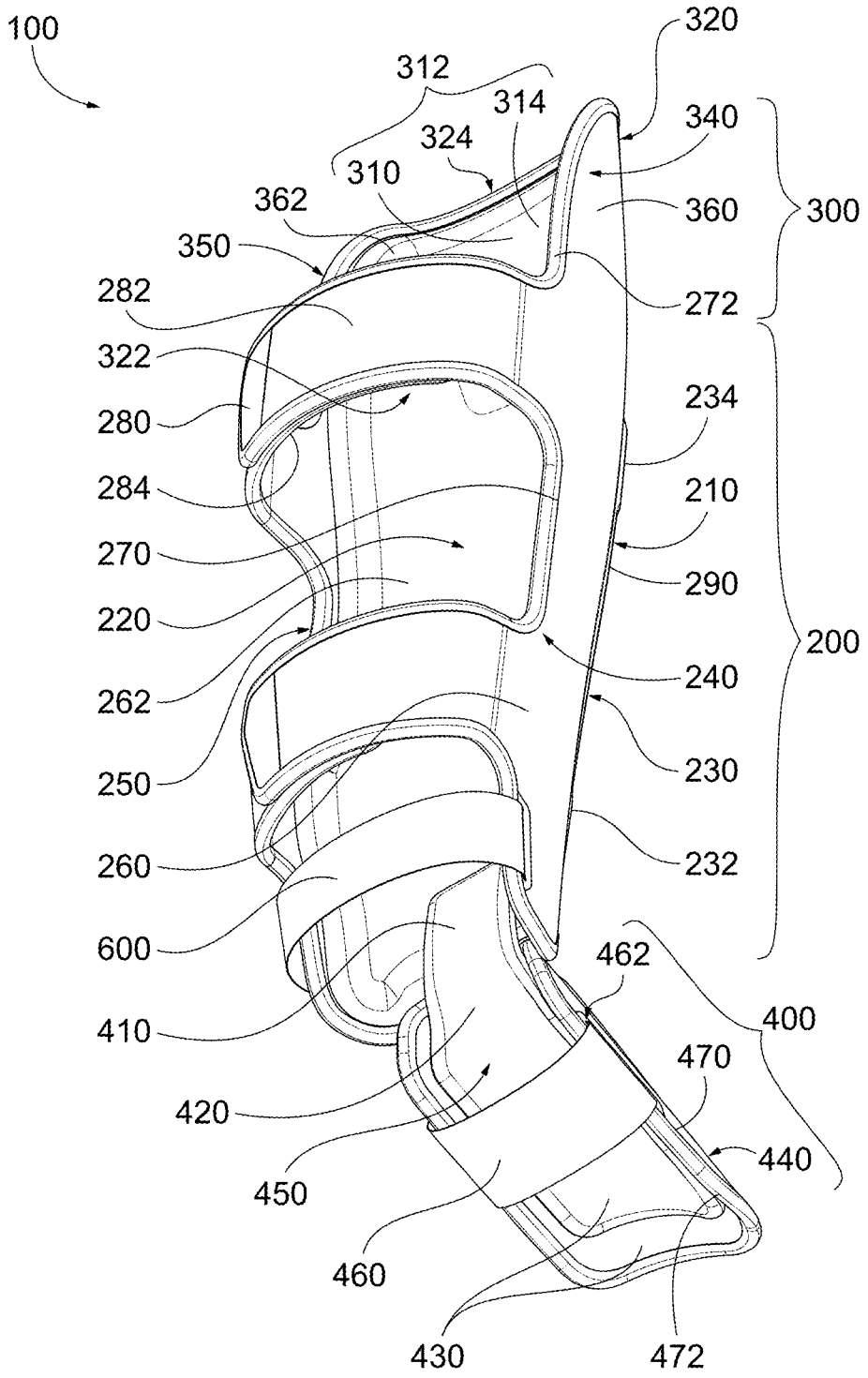
FIG. 2 is a back perspective view of a lower extremity combat training device, in accordance with an example of the disclosure.
Figure 3A:
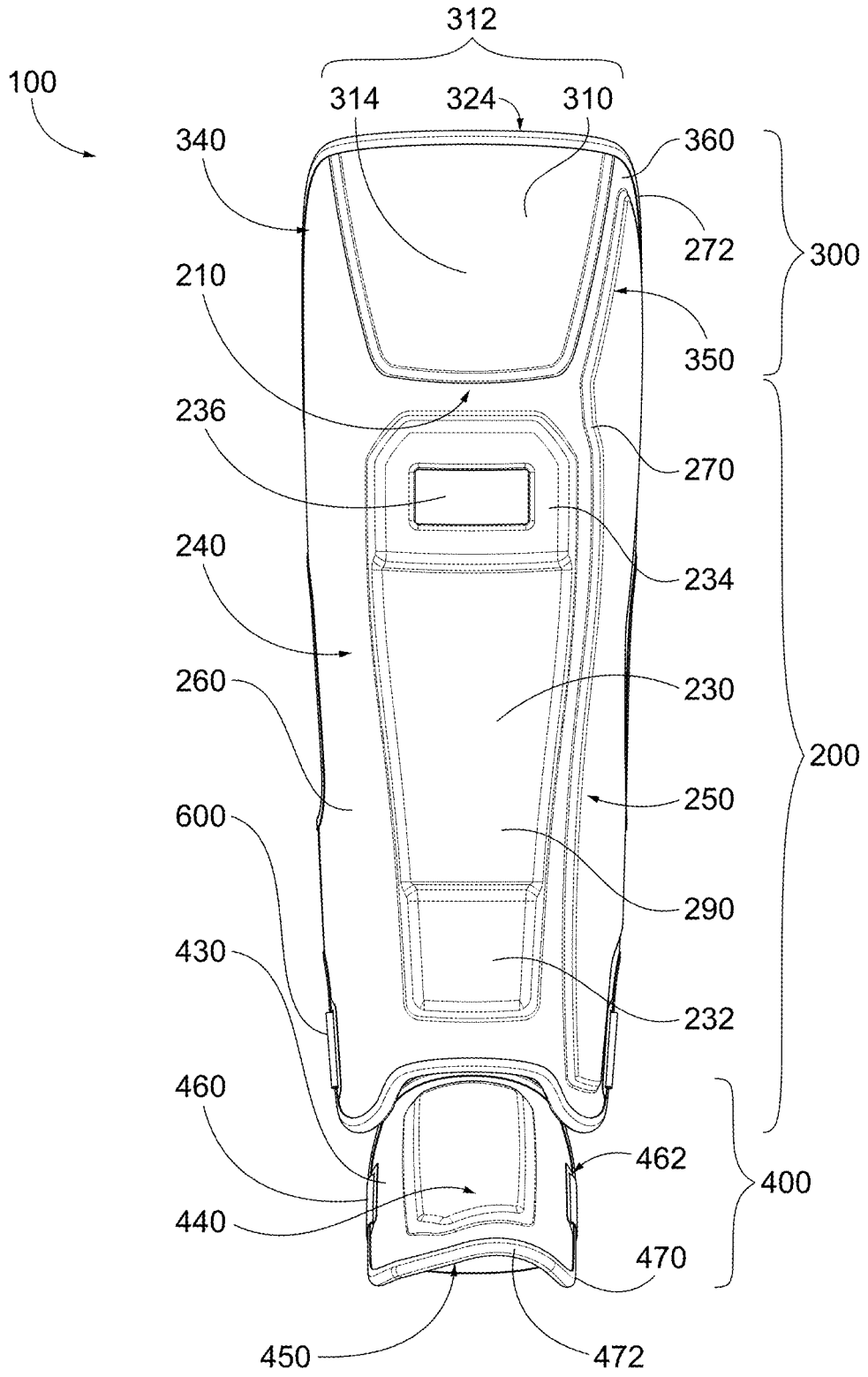
FIG. 3A is a front view of a lower extremity combat training device, in accordance with an example of the disclosure.
Figure 3B:
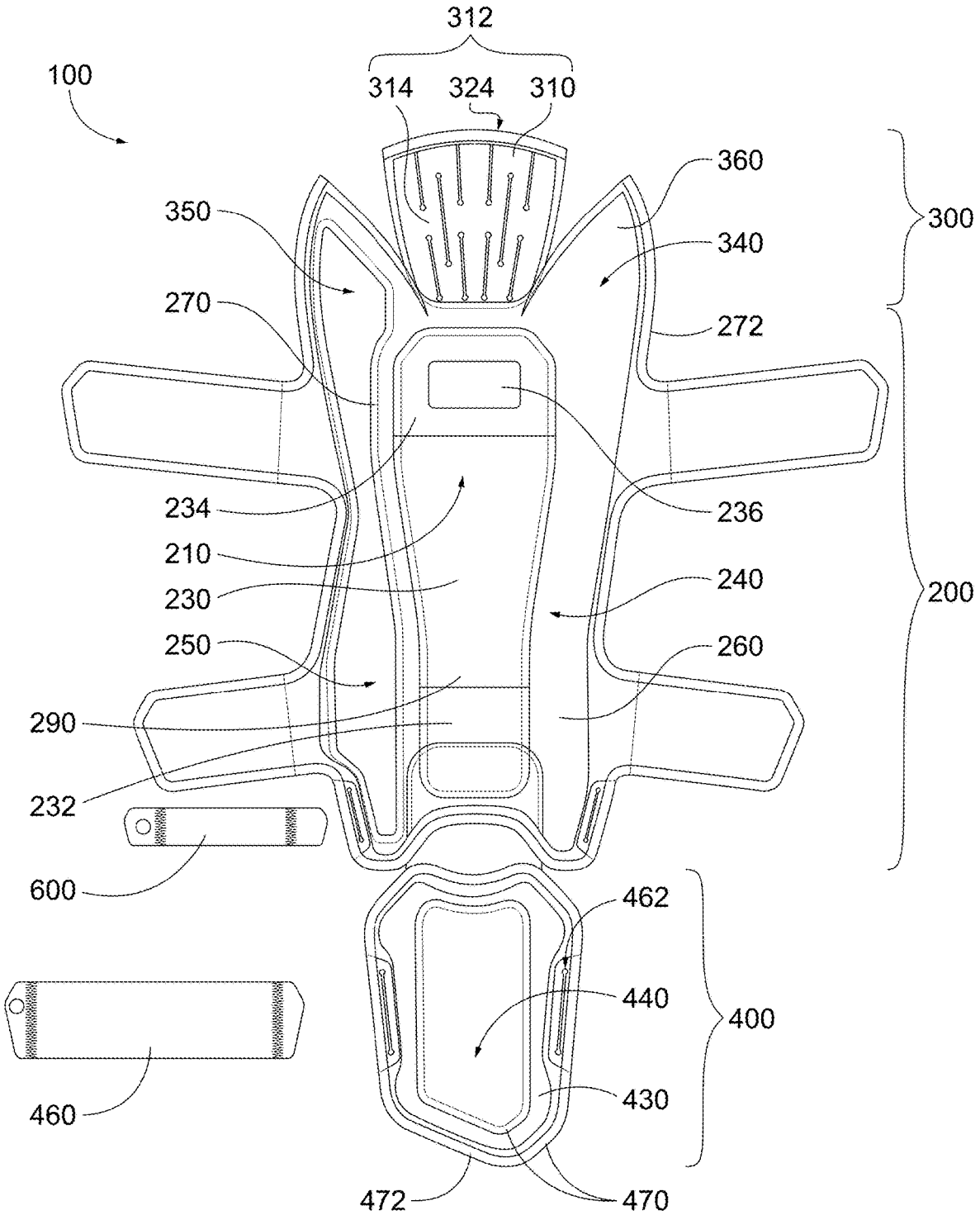
FIG. 3B is a front view of a lower extremity combat training device in a flattened pattern layout for illustrative purposes, in accordance with an example of the disclosure.
Figure 4A:
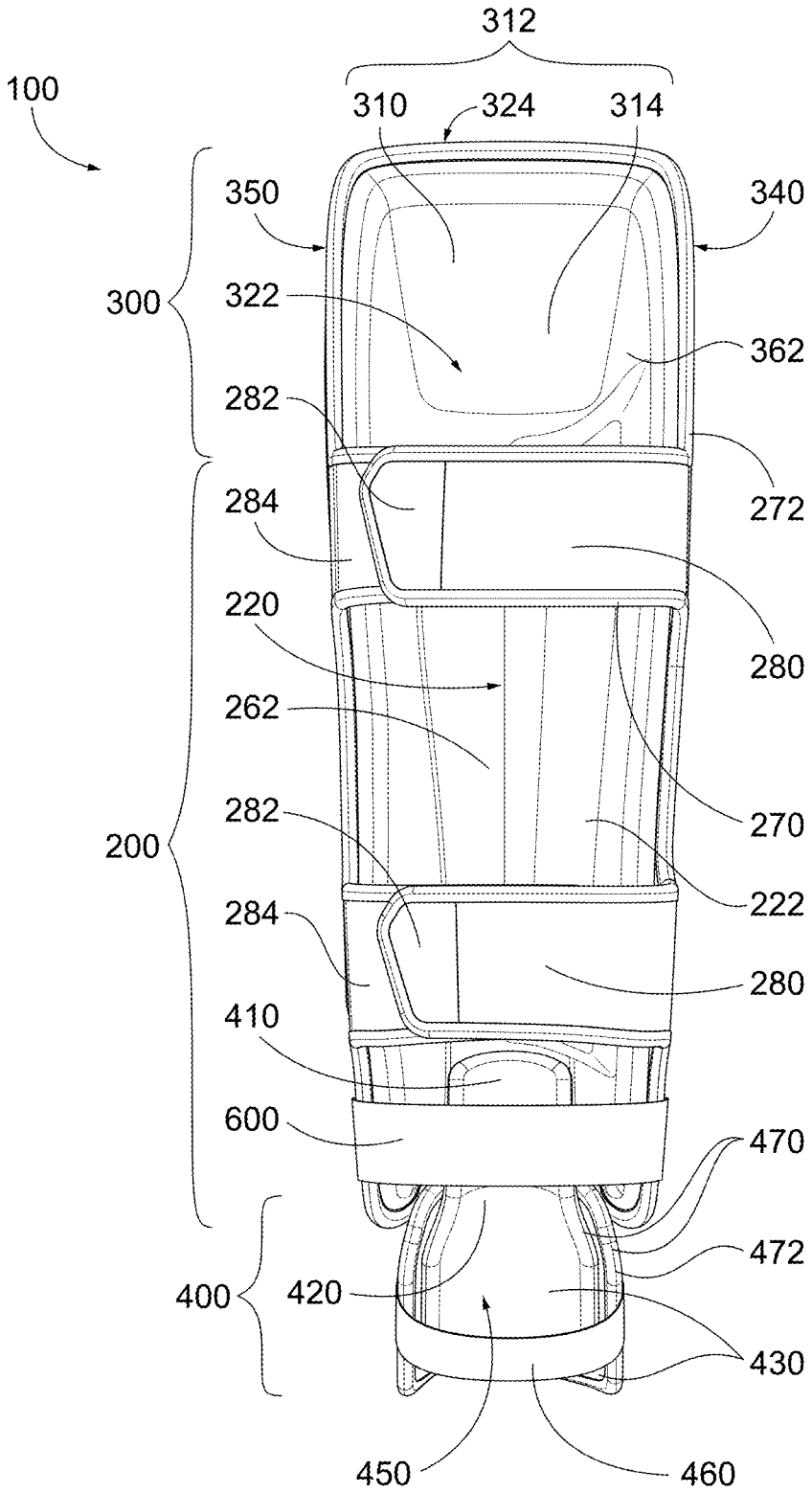
FIG. 4A is a back view of a lower extremity combat training device, in accordance with an example of the disclosure.
Figure 4B:
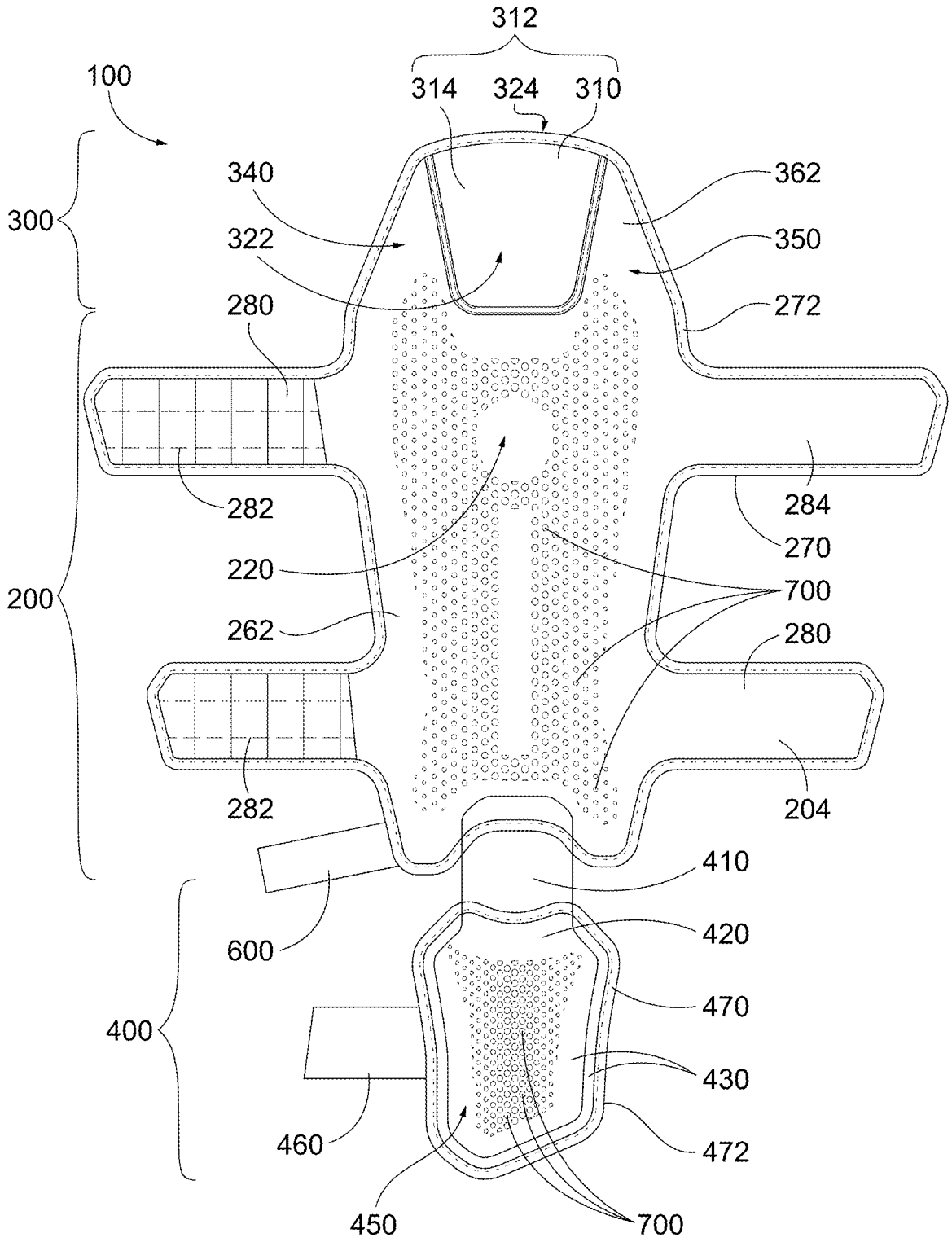
FIG. 4B is a back view of a lower extremity combat training device in a flattened pattern layout for illustrative purposes, in accordance with an example of the disclosure.
Figure 5:
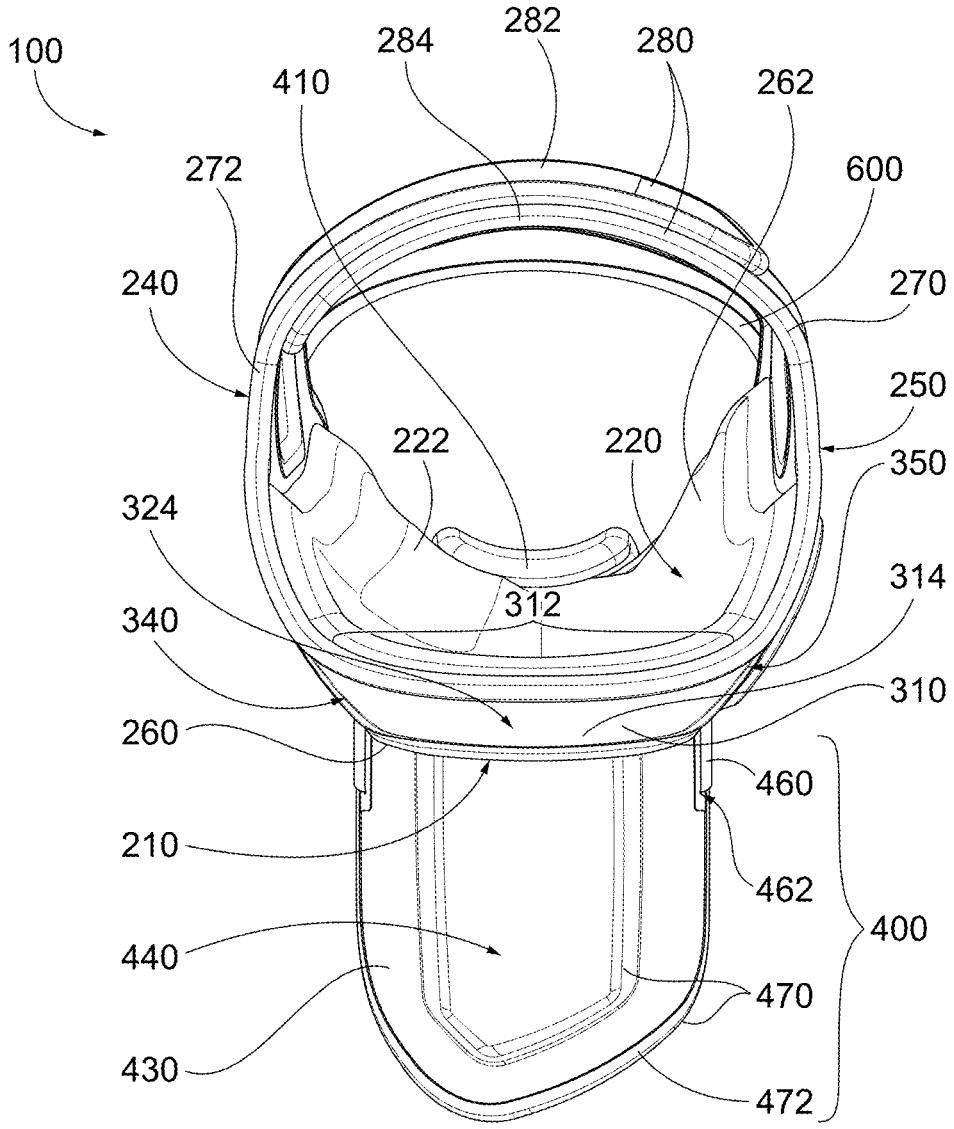
FIG. 5 is a top side view of a lower extremity combat training device, in accordance with an example of the disclosure.
Figure 6:
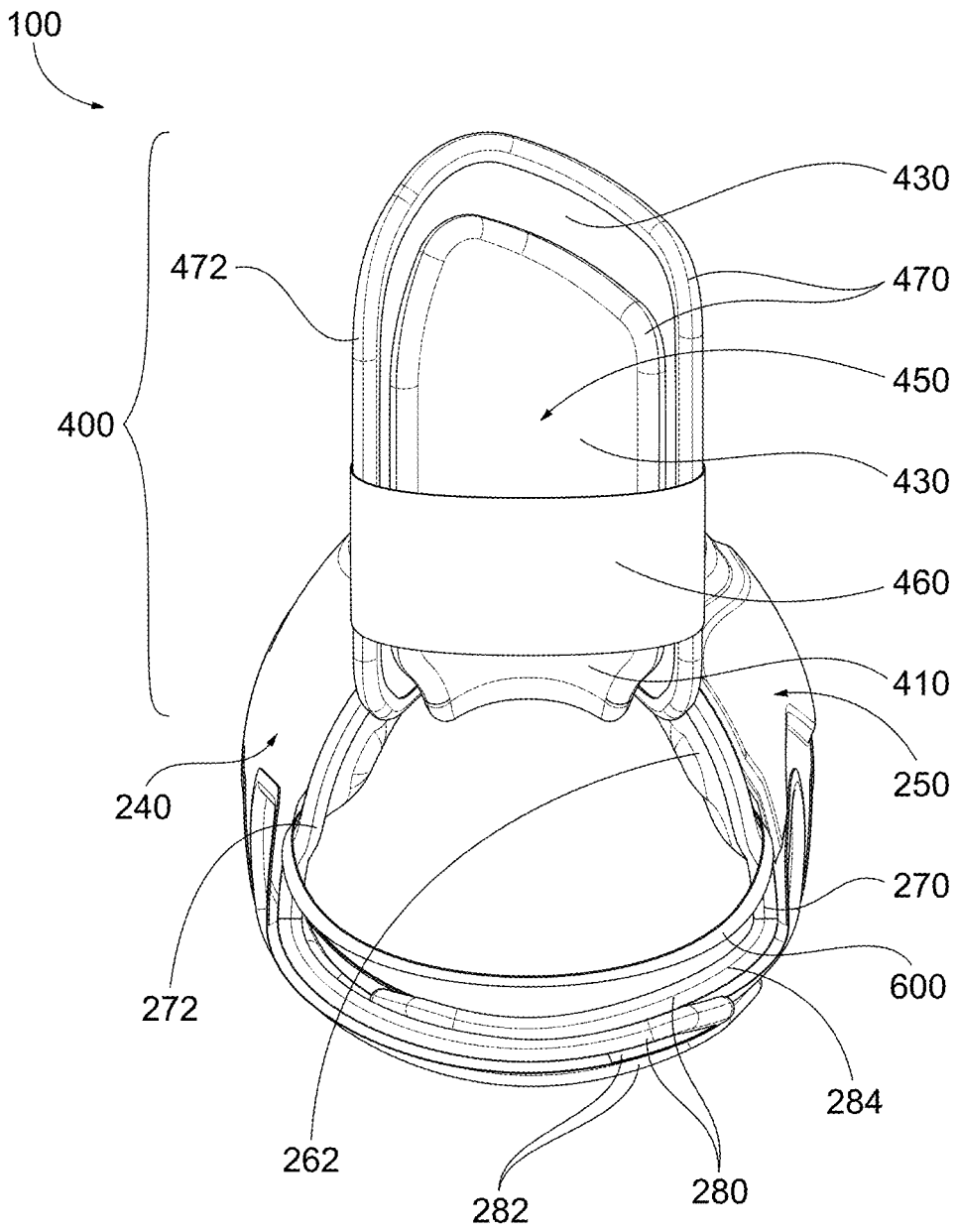
FIG. 6 is a bottom side view of a lower extremity combat training device, in accordance with an example of the disclosure.
Figure 7:
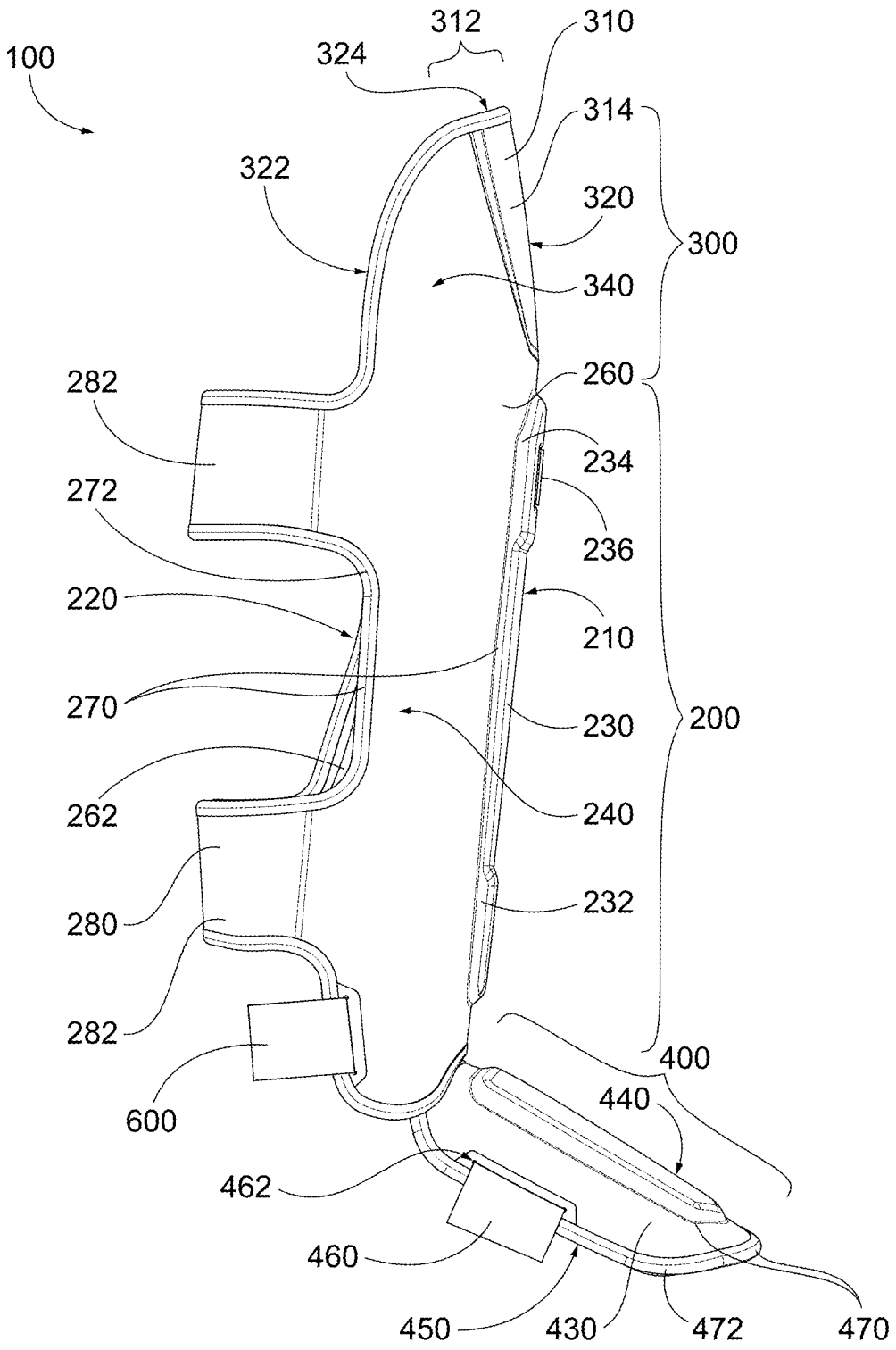
FIG. 7 is a medial side view of a lower extremity combat training device, in accordance with an example of the disclosure.
Figure 8:
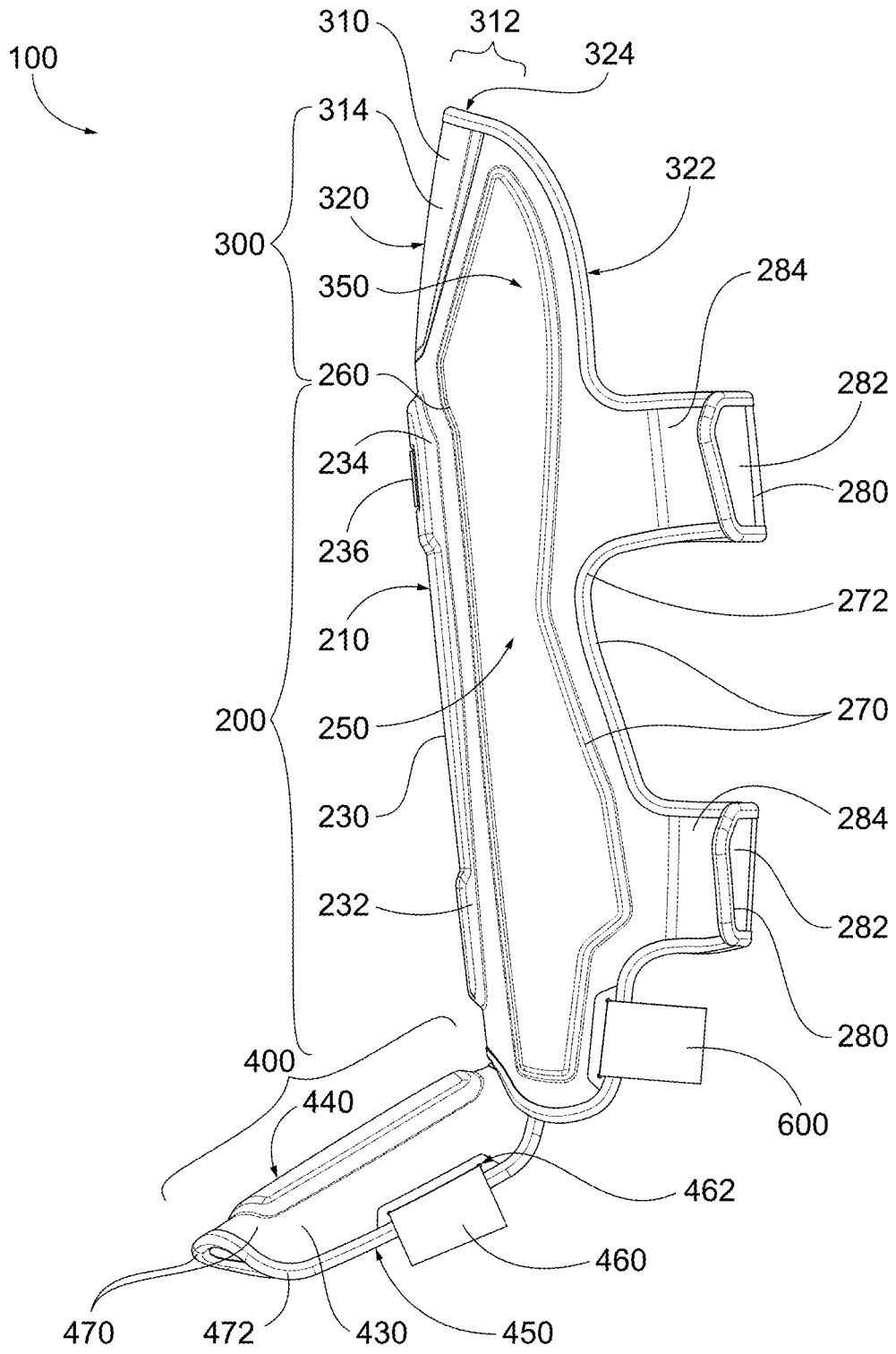
FIG. 8 is a lateral side view of a lower extremity combat training device, in accordance with an example of the disclosure.
Figure 9:
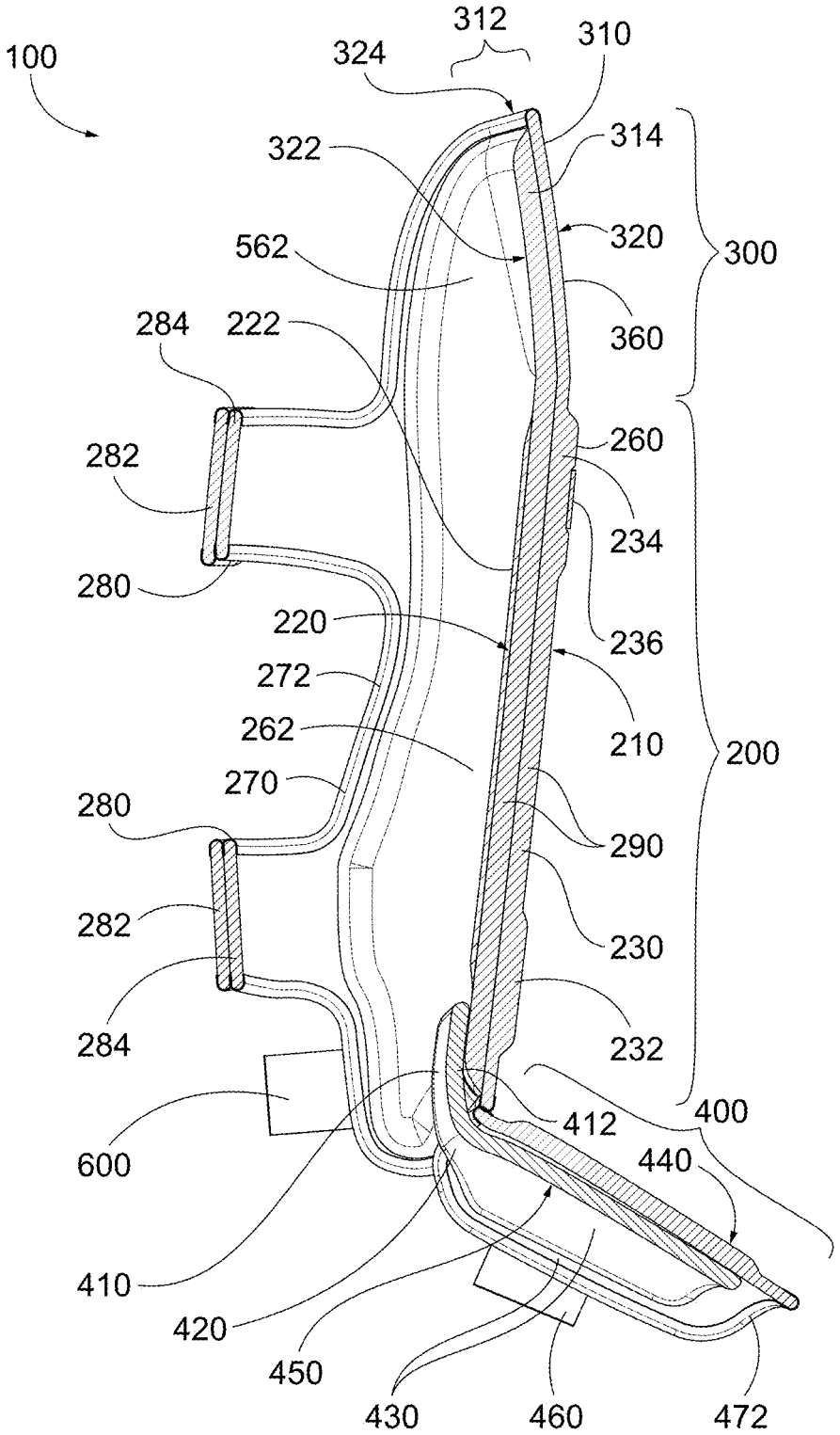
FIG. 9 is a cross section of a lower extremity combat training device taken at line 9-9 of FIG. 1, in accordance with an example of the disclosure.
Figure 10A:
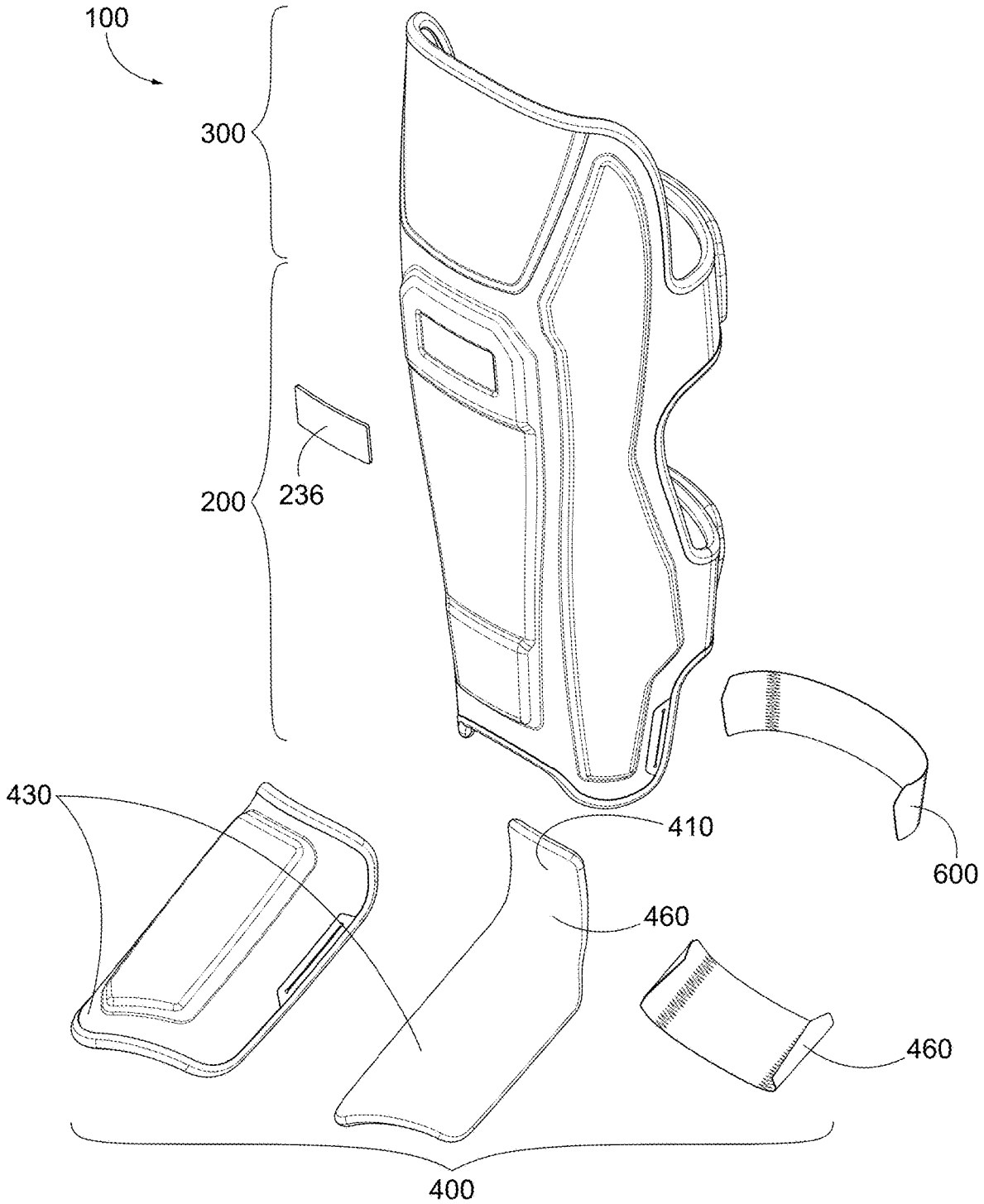
FIG. 10A is an exploded view of a front perspective view of a lower extremity combat training device, in accordance with an example of the disclosure.
Figure 10B:
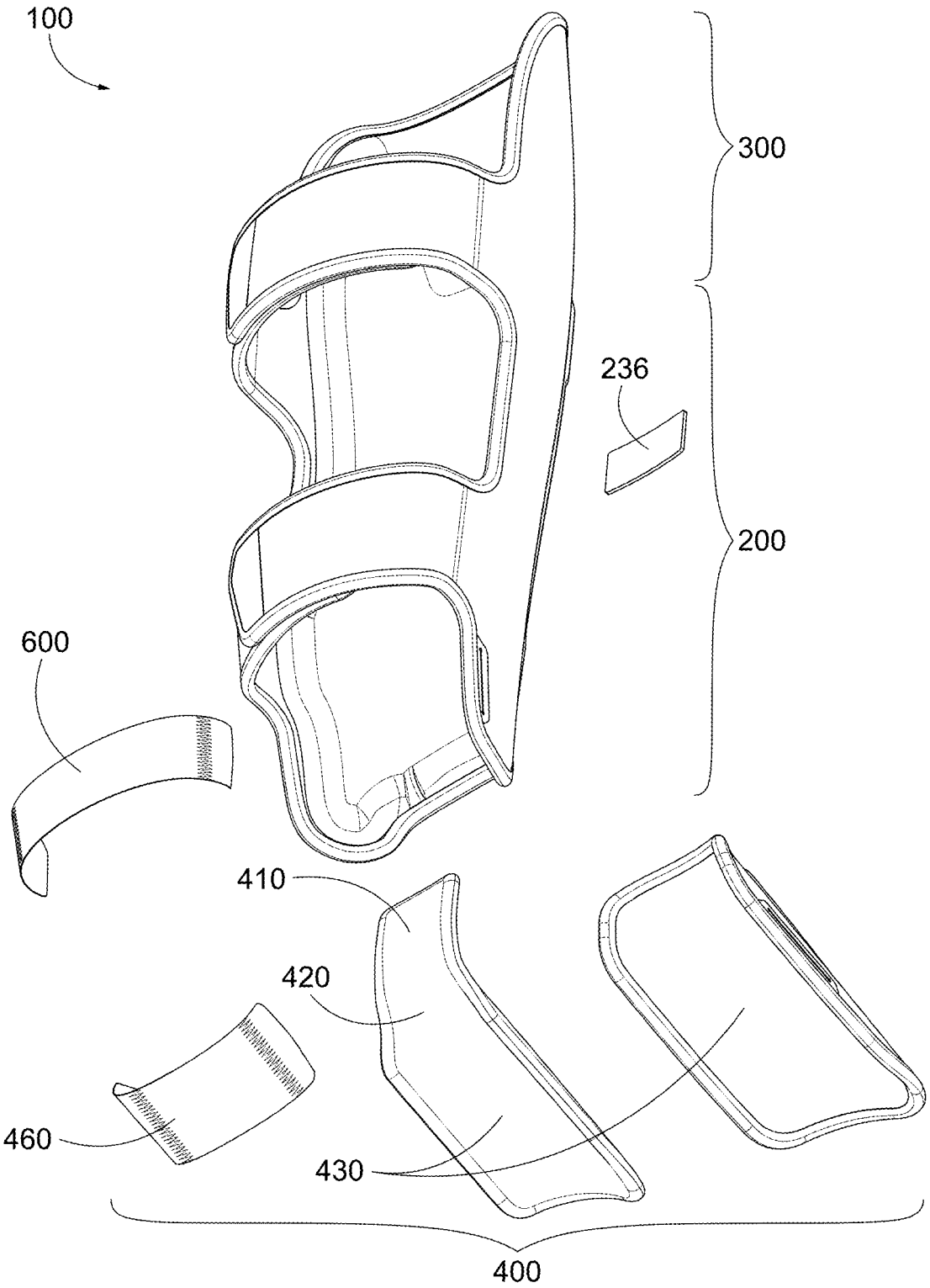
FIG. 10B is an exploded view of a back perspective view of a lower extremity combat training device, in accordance with an example of the disclosure.
Figure 11:
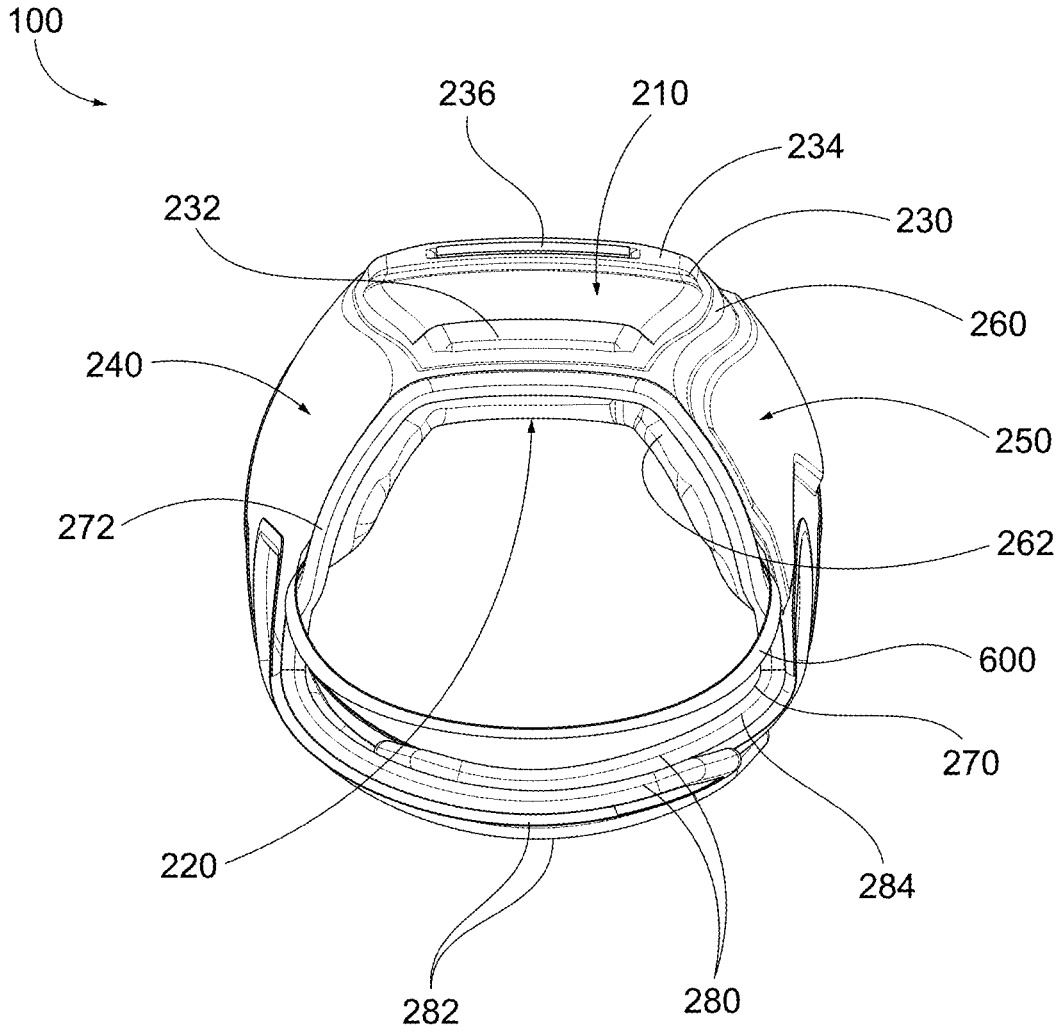
FIG. 11 is a bottom view of a shin guard of a lower extremity combat training device, in accordance with an example of the disclosure.
Figure 12:
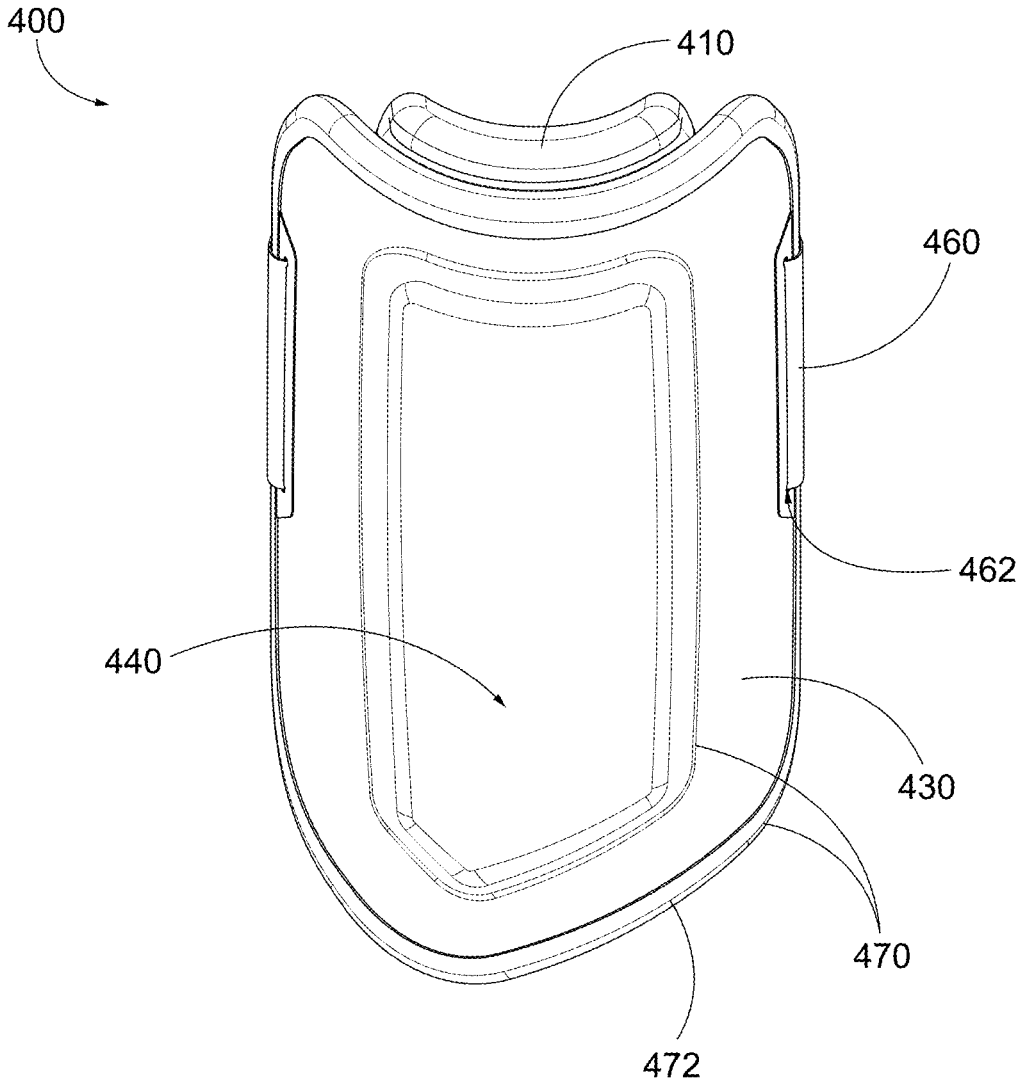
FIG. 12 is a top view of a dorsum guard of a lower extremity combat training device, in accordance with an example of the disclosure.
Figure 13:
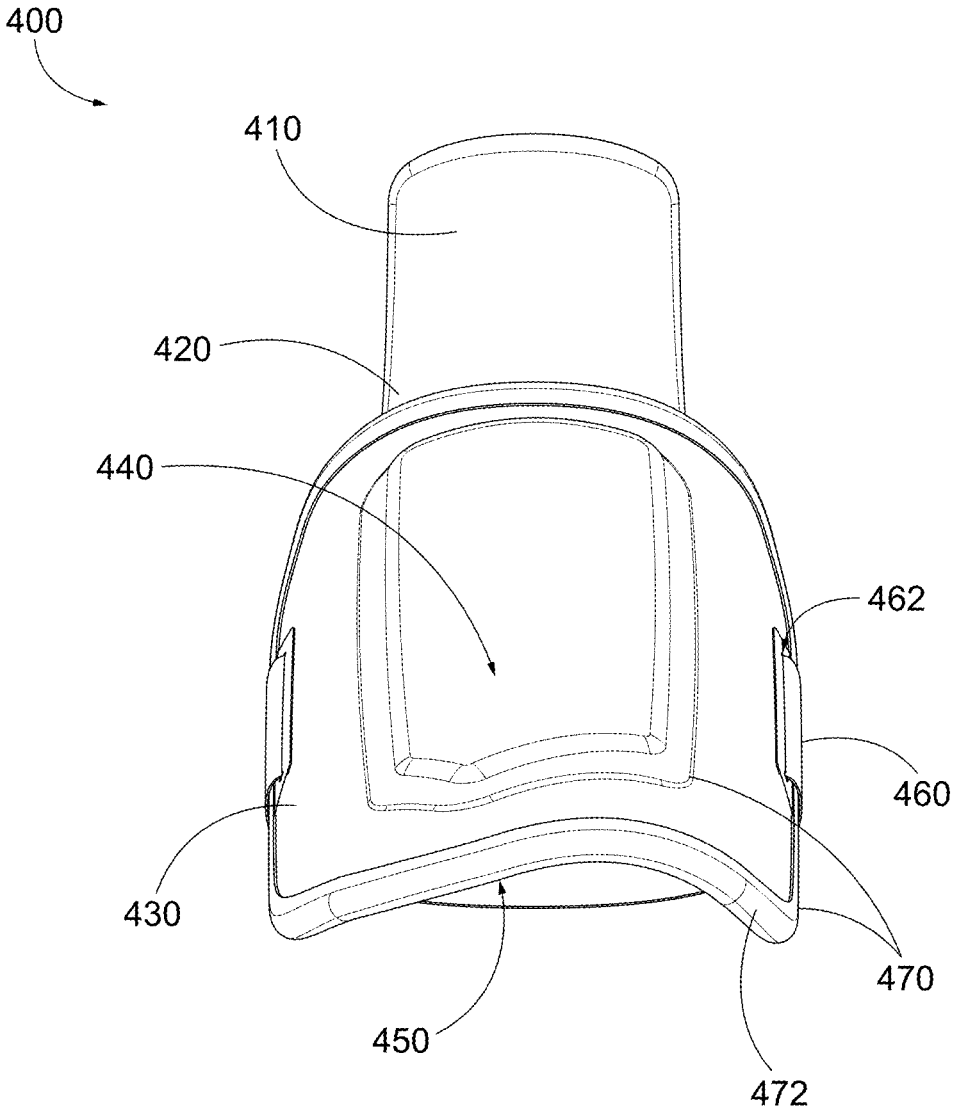
FIG. 13 is a front view of a dorsum guard, in accordance with an example of the disclosure.

FIGS. 1-2 are perspective views of an example of a lower extremity combat training device 100. FIG. 1 is a front perspective of a lower extremity combat training device 100 and FIG. 2 is a back perspective of a lower extremity combat training device. FIGS. 3A-3B are front views of the lower extremity combat training device of FIGS. 1-2. The features of FIGS. 3A-3B are labeled as described herein in FIG. 1, for features visible from the respective front views. FIGS. 4A-4B are back views of the lower extremity combat training device of FIGS. 1-2. The features of FIGS. 4A-4B are labeled as described herein in FIG. 2, for features visible from the respective back views. In similar fashion, FIG. 5 is a top view of the lower extremity combat training device 100 of FIGS. 1-2 and illustrates features visible from the top view as described with respect to FIGS. 1-2. Likewise, FIG. 6 is a bottom view of the lower extremity combat training device 100 of FIGS. 1-2 and illustrates features visible from the bottom view as described with respect to FIGS. 1-2. FIGS. 7-8 are medial and lateral side views, respectively, of the lower extremity combat training device and illustrate features visible from the respective side views, as otherwise described with respect to FIGS. 1-2. FIG. 9 is a cross-section of FIG. 1 taken at line 9-9, illustrating features visible from the cross-section as otherwise described with respect to FIGS. 1-2. FIGS. 10A-10B are exploded perspective views of the lower extremity combat training device 100 of FIGS. 1-2 and illustrate removable and replaceable features as otherwise described with respect to FIGS. 1-2. FIG. 11 is a bottom view of the lower extremity combat training device 100 of FIG. 6 with the dorsum guard 400 of FIG. 6 removed. FIG. 12 is a top view of the dorsum guard 400 of the lower extremity combat training device 100 of FIG. 5 with the shin guard 200 and the knee guard 300 of the lower combat training device 100 of FIG. 5 removed. FIG. 13 is a front view of the dorsum guard 400 of the lower extremity combat training device 100 of FIG. 3A with the shin guard 200 and the knee guard 300 of the lower combat training device 100 of FIG. 3A removed.

In FIG. 1, the lower extremity combat training device 100 comprises a shin guard 200, a knee guard 300, and a dorsum guard 400. The shin guard comprises a front 210 and a back 220 (as further illustrated by FIG. 2). A centrally positioned pad 230 extends forward from the face of the front 210 of the shin guard 200 and defines the region of the shin guard which protects the front of a shin of a lower extremity when in use. The centrally positioned pad 230 may have varying pad layers, thicknesses, and densities therein. By example, thickened regions 232, 234 of the centrally positioned pad 230 of FIG. 1 are positioned at the lower most region of the centrally positioned pad 230 and the upper most region of the centrally positioned pad 230. The thickened region (or any other varying region(s) of padding) may be a product of padding having a different density than the remaining portions of the centrally positioned pad 230, multiple layers of padding different than the remaining portions of the centrally positioned pad 230, the integrations of rigid material within the padding to support the centrally positioned pad 230, or any combination thereof. The centrally positioned pad 230 may be a centrally positioned raised pad. Additionally, or alternatively, any portion of the centrally positioned pad 230 may comprise any of these features or a combination thereof. An upper thickened region 234 of the centrally positioned pad 230 may additionally comprise a framed recess for receiving a label 236 for branding, such as a label used by professionals for commercial purposes or for identification of a practitioner's nationality by representation of a flag. Such a label may be attached by any means known in the art such as, for example, stitching, hook and loop, adhesive, a combination thereof, or the like.

FIG. 1 further illustrates a padded medial side 240 and a padded lateral side 250 of the shin guard 200. The padded medial side 240 and the padded lateral side 250 recess in a direction toward the back 220 (as further illustrated by FIG. 2) of the lower extremity combat training device 100 from the centrally positioned pad 230. The padded medial side 240 and the padded lateral side 250 follow a concave shape of the back 220 (as illustrated by FIG. 2) of the lower extremity device. The curvature of the lower extremity combat training device provides for a proper fit around a practitioner's shin and protects the side of the practitioner's leg such as, for example, to provide protection to peroneal nerve and muscles on the lateral side (outside) of a leg. In some examples, the padded lateral side 250 of the lower extremity combat training device 100 may be larger than the padded medial side 240 of the lower extremity combat training device 100. In other words, the padded lateral side 250 may extend further from the centrally positioned pad 230 than the padded medial side 240. This may provide increased protection to the lateral (outside) side of a practitioner's leg that has more exposure than the medial (inside) of a practitioner's leg. In examples, the padding of the padded lateral side 250 extends the entire length (from top to bottom) of the shin guard 200 and may, additionally, extend into the lateral side of the knee guard 350 in this regard, as further discussed below. Additionally, or alternatively, the padded lateral side 250 may comprise additional padding or increased padding as compared to the padded medial side 240. Moreover, by limiting size and padding of the padded medial side 240, the padded medial side 240 does not impede movement of the leg, in use, by preventing contact or entangling with the other leg of a practitioner, or with a lower extremity combat training device 100 on the other leg of a practitioner. Accordingly, the lower extremity combat training device may be asymmetrical about a central axis extending from the knee guard 300 to the dorsum guard 400.

As illustrated by FIGS. 4A, 5, and 9, a comfort strip 222 may be integrally provided or separably applied to the back 220 of the lower extremity device. The comfort strip 222 is provided to accommodate the irregular shape of the anatomy of a user's shin. It is known a shin is not perfectly linear, convex, or consistently shaped. Therefore, a comfort strip 222 may be provided to accommodate such. The comfort strip 222 may be customizable to a user (i.e., a user's anatomy), such as utilizing customizable foam like customizable insoles for a shoe. It may be said that the comfort strip 222, therefore, interrupts the concavity of the back 220 of the lower extremity device.

As illustrated by FIG. 1, the various regions of padding may be secured within a skin 260. The skin 260 may be of any durable material such as leather, synthetic, fabric, a combination thereof, or the like. Multiple materials may be relied on for skin 260. Padding and/or other materials relied on within the depth (e.g., thickness) of the lower extremity combat training device 100 are positioned beneath the skin 260. Stitching 270 may be provided to maintain the padding and/or other materials in their respective positions beneath the lower extremity combat training device 100. FIG. 9 is a cross section of a lower extremity combat training device taken at line 9-9 of FIG. 1 further illustrating varying thicknesses and orientation of padding 290, skin 260, and stitching 270 as described above in view of the regions otherwise described by FIG. 1.

Still referring to FIG. 1, the lower extremity combat training device may comprise straps 280 extending directly from padded medial side 240 and the padded lateral side 250 of the shin guard 200. As illustrated by FIG. 1, the straps 280 may be integral to the padded medial side 240 and the padded lateral side 250. In this regard the skin 260 of the padded medial side and the padded lateral side 250 may extend, respectively, onto the straps. Additionally, or alternatively, the straps 280 may be stitched directly to the respective padded medial side 240 and the padded lateral side 250. In the example of FIG. 1, a pair of straps 280 extend from the padded medial side 240 and a pair of straps 280 extend from the padded lateral side 250. A first strap 282 of the padded medial side 240 engages a first strap of the padded lateral side 250. Similarly, a second strap 284 of the padded medial side 240 engages a second strap of the padded lateral side 250. They may engage by hook and loop, mechanical connection, ties, a combination thereof, or the like. The straps 280 secure the lower extremity combat training device 100 to a practitioner's leg. In the example of FIG. 1, the straps extend from the lower extremity combat training device in the region of the centrally positioned pad 230. In other words, the straps 280 are maintained at the shin guard 200. In some examples, no straps extend from the knee guard 300 which is positioned above the centrally positioned pad 230 and the shin guard 200.

In an alternative example, the knee guard may comprise one or more straps, in addition to the shin guard straps, should that be a user's preference. The knee guard strap may be similar to and parallel to the shin guard straps, at the knee guard. The knee guard strap may be removable and/or adjustable as described with respect to the strap of the dorsum guard. Corresponding apertures may be provided in the shin guard for such, such as, for example as described and illustrated with respect to the dorsum guard and/or Achilles guard, below. Alternatively, the knee guard strap may be rigid, and a direct extension of the knee guard as described with respect to the shin guard straps.

It is contemplated herein, straps may be removable and/or adjustable as described with respect to the strap of the dorsum guard, below. Corresponding apertures may be provided in the knee guard and/or shin guard for such, such as, for example as illustrated with respect to the dorsum guard and/or Achilles guard, below.

As further illustrated by FIG. 1, the padded medial side 240 and the padded lateral side 250 extend from the shin guard 200 to above and meet overtop the centrally positioned pad 230 at the knee guard 300. These regions of the padded medial side 240 and the padded lateral side 250 at the knee guard 300 are referred to as the medial side of the knee guard 340 and the lateral side of the knee guard 350, respectively. The knee guard 300 is an extension of the shin guard 200. In this regard, the material (e.g., skin 260, pads, a combination thereof, or the like) of the padded medial side 240 and the padded lateral side 250 extends continuously and unbroken into the medial side of the knee guard 340 and the lateral side of the knee guard 350. The medial side of the knee guard 340 and the lateral side of the knee guard 350, and accordingly the knee guard 300, remain aligned with and move with the padded medial side 240 and the padded lateral side 250, respectively, and the shin guard 200. Accordingly, the knee guard 300 is supported upon a practitioner's leg by the shin guard 200 and the straps 280 of the shin guard. The knee guard 300 does not require any additional or separate attachment method to the leg of a practitioner. One, or both, of the medial side of the knee guard 340 and the lateral side of the knee guard 350 may flare, or widen, as they extend into the knee guard, away from the shin guard 200. By flaring the medial side of the knee guard 340 and/or the lateral side of the knee guard 350 the knee guard 300 may wrap about the sides and a top of a practitioner's knee, thereby cupping and providing protection to the front, sides, top, and bottom (in combination with the shin guard 200) of a practitioner's knee.

In the example of FIG. 1, the knee guard 300 further comprises a padded knee cavity 310. The padded knee cavity 310 may be secured between the medial side of the knee guard 340 and the lateral side of the knee guard 350. The padded knee cavity 310 may be of a different material than the medial side of the knee guard 340 and the lateral side of the knee guard 350 or may be an extension of the material of the medial side of the knee guard 340 and the lateral side of the knee guard 350. By example, the medial side of the knee guard 340 and the lateral side of the knee guard 350 may be more rigid than the padded knee cavity 310. This may be accomplished by different padding or by using the same padding with different layering and/or density.

The padded knee cavity 310 may comprise a fabric pouch 312 stitched closed and/or stitched between the medial side of the knee guard 340 and the lateral side of the knee guard 350. The fabric pouch may encapsulate the padding 314 of the padded knee cavity 310. Alternatively, the padding 314 within the padded knee cavity 310 may be an extension of the padding of the shin guard where the stitching of the pouch simply defines a line of demarcation between the padded knee cavity 310 and the padded shin guard, the padded medial side of the knee guard 340, and/or the padded lateral side of the knee guard 350. In other words, the padding 314 within the padded knee cavity may be the same padding as the shin guard and may simply be slotted and/or stitched differently to impart the elasticity noted below.

The fabric pouch 312 may comprise an elasticity, or be elastic (e.g., stretchable with recoil) allowing it to expand but return to an original retracted shape cupping a practitioner's knee. Similarly, the stitching of one or more sides of the fabric pouch 312 may also comprise an elasticity allowing it to expand but return to an original retracted shape cupping a practitioner's knee. The padding 314 of the padded knee cavity 310 may additionally be a flexible padding. A flexible padding of the knee guard 300 may be a padding comprising an elasticity allowing it to expand but return to an original retracted shape. In some examples, the padding of the knee guard 300 may be padding comprising one or more serrations extending from the top side of the padding and/or within the padding. The serrations allow the padding of the knee guard 300 to expand and contract within the fabric pouch 312 and, in some examples, expand and contract with a fabric pouch 312 comprising the aforementioned elasticity, without impeding the elasticity of the fabric pouch 312. In some examples, the padding 314 of the knee guard 300 is not adhered to the fabric pouch 312 and may float freely, expand and contract freely, etc. within the fabric pouch 312. In other examples, the padding 314 of the knee guard 300 is adhered to or is a part of the fabric pouch 312, moving directly with the expansion and contraction of the fabric pouch.

Figure 17:
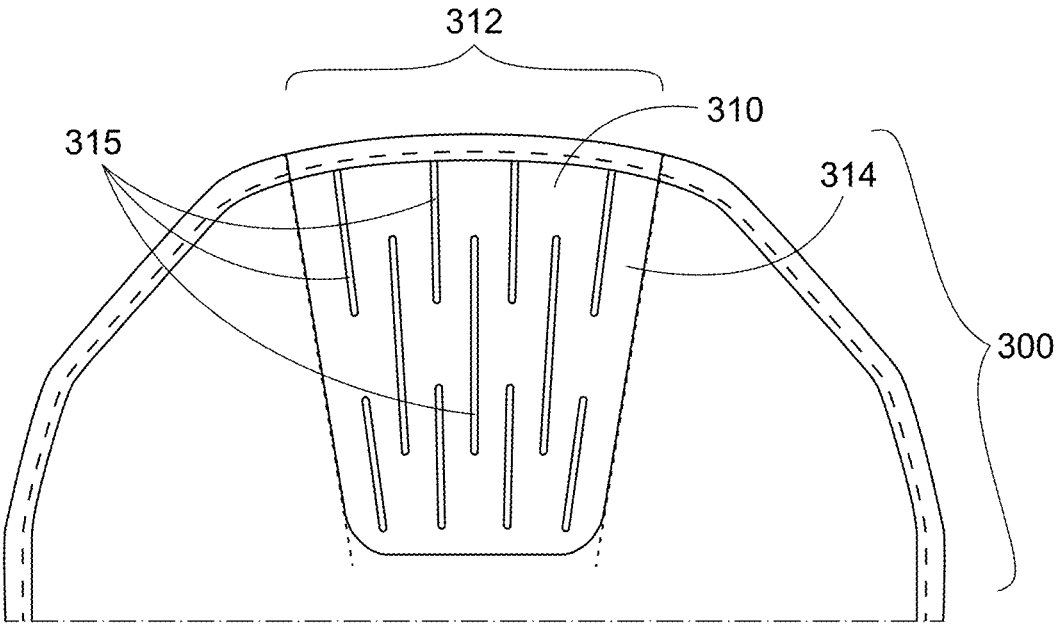
FIG. 17 is a front view of a knee guard of a lower extremity combat training device with a padded knee cavity, in accordance with an example of the disclosure.
Figure 18:
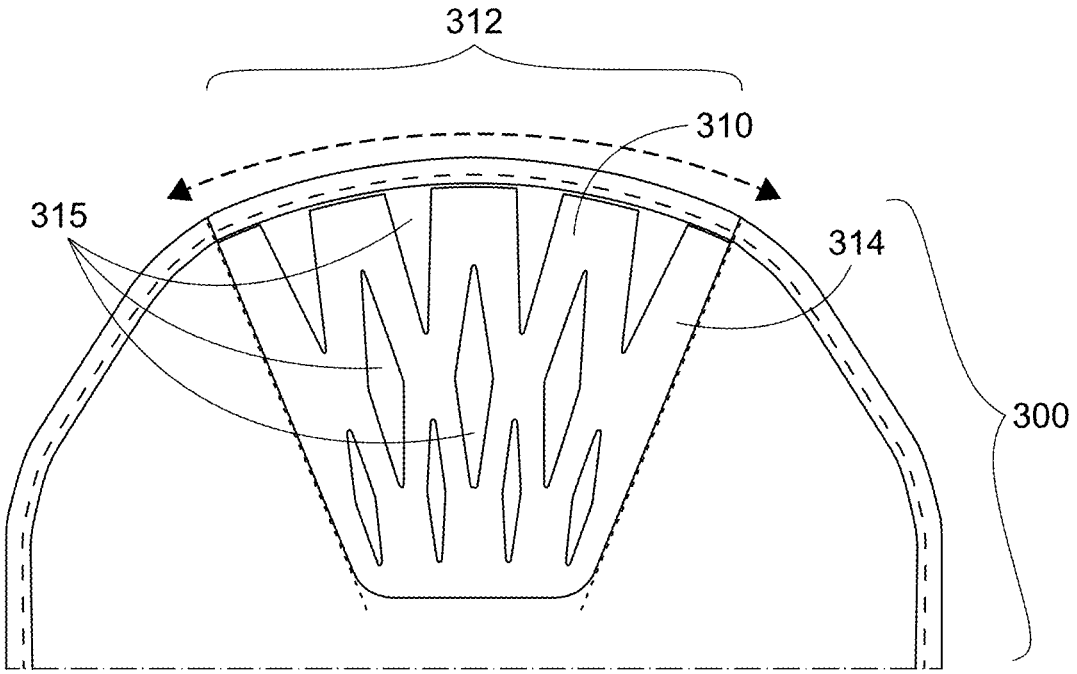
FIG. 18 is a front view of a knee guard of the lower extremity combat training device with a padded knee cavity expanded, in accordance with an example of the disclosure.

FIG. 17 is a partial view of the front side of the knee guard 300 of FIG. 1, with features labeled as described in FIG. 1 above, with the characteristics of the underlying padding 314 illustrated through the fabric pouch 312 of the knee cavity 310. In FIG. 17, the padded knee cavity 310, the stitching thereon, and/or the flexible padding 314 of the knee guard 300 is in a non-expanded or retracted position. In other words, the elasticity of fabric pouch 312, and/or the components thereof, are not forced to stretch upon movement by the practitioner in use and the knee guard 300 maintains its cupped shape about a practitioner's knee. Serrations 315 of the padding 314 are illustrated. Comparatively, FIG. 18 is also a partial view of the front side of the knee guard 300 of FIG. 1, with the characteristics of the underlying padding 314 illustrated through the fabric pouch 312 of the knee cavity 310. In FIG. 18, the elasticity of the fabric pouch 312, the stitching thereon, and/or the padding 314 of the fabric pouch 312 are stretched and expanded. In other words, the elasticity of the fabric pouch 312, and/or the components thereof, are forced to stretch under movement of the lower extremity without impeding movement of the lower extremity or without being fastened directly to the lower extremity, itself. Yet, the elasticity of the fabric pouch 312, and/or the components thereof, provide that the fabric pouch 312, and/or the components thereof, return to their original form cupping the knee. Serrations 315 of the padding 314 are illustrated.

By providing a knee guard 300 comprising a padded knee cavity that is flexible, elastic, or the like, the knee guard is able to cup a practitioner's knee while still accommodating movement of the practitioner's knee without impeding movement when in use. Yet, by providing a medial side of the knee guard 340 and a lateral side of the knee guard 350, that is an extension of and moves with the padded medial side 240 and the padded lateral side 250 of the shin guard 200, respectively, the knee guard 300 does not require additional straps or mechanisms for securing the knee guard to a practitioner's lower extremity that might, otherwise, provide additional points of failure in the device and/or restrict movement of a practitioner's lower extremity at the knee (i.e., to accommodate varying user's preferences or for particular uses).

Referring again to FIG. 1, the lower extremity combat training device 100 of FIG. 1 further illustrates a dorsum guard 400. In this example, the dorsum guard 400 is removable from the shin guard. In other words, it is contemplated herein that a lower extremity combat training device 100 may not include a dorsum guard 400. Moreover, a removable dorsum guard 400 allows replacement of the dorsum guard 400 without the entire replacement of the remaining components of the lower extremity combat training device 100. In this regard, the dorsum guard 400 may require replacement at greater occurrence than the remaining components of the lower extremity combat training device 100 in view of the foot and, accordingly, the dorsum guard 400 being relied on as a striking surface in training.

The dorsum guard 400 of FIG. 1 may be adhered to the back 220 of the shin guard. Because the dorsum guard 400 attaches to and extends from the back 220 of the shin guard additional padding and protection is afforded at the lower shin area, overtop the ankle joint. The additional padding provided by the dorsum guard 400 extending into the shin guard also provides additional recessed padding beneath the padding the shin guard which further sets on and protects the shin. Additional padding may be provided in the padded lateral side 250 and/or padded medial side 240 of the shin guard 200, independent of or as an extension to the additional padding provided by the dorsum guard 400, for this very purpose as well. In this regard, the additional padding at the padded lateral side 250 and/or the padded medial side 240 of the shin guard may additionally be non-linear the length of the shin guard (e.g., top to bottom).

The dorsum guard 400 may be adhered to the back 220 of the shin guard by hook and loop, mechanical connection, ties, or the like. In FIG. 1, the dorsum guard 400 is adhered to the back 220 of the shin guard 200 behind and below the centrally positioned pad 230. The additional padding extending from the dorsum guard 400 into the shin guard area may also extend the full length of the dorsum guard 400, itself. The dorsum guard may additionally be provided two independent layers of padding above the foot. By example, the padding of the dorsum guard 400 that extends from the shin guard area may further comprise an additional top layer of padding or alternative material(s) (e.g., cap, cover, etc.) that is otherwise aligned with the shin guard, forward of the dorsum guard 400 padding that extends from the back 220 of the shin guard, for additional protection thereover.

Figure 14:
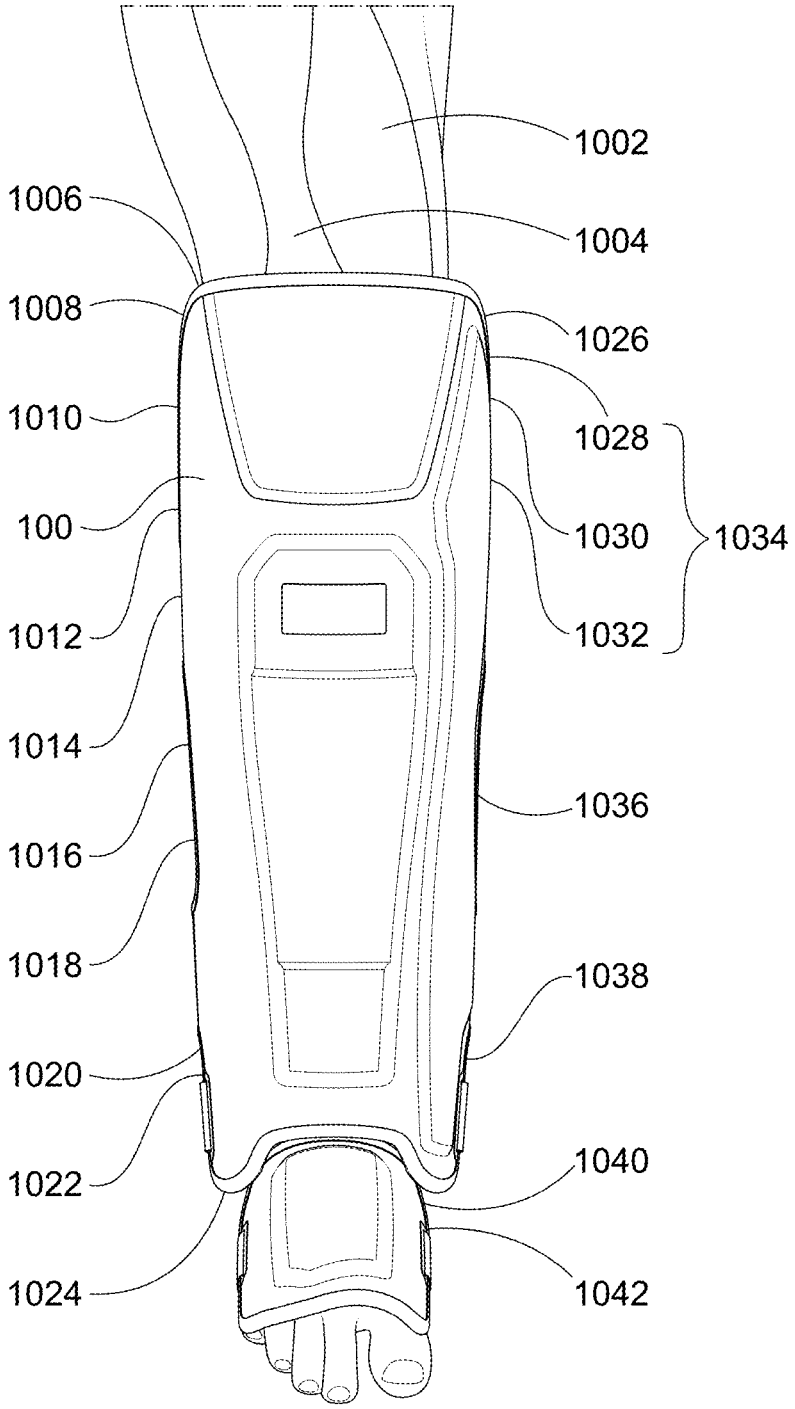
FIG. 14 is a front view of a dorsum guard overlayed over the skeletal anatomy of a foot and a lower extremity, in accordance with an example of the disclosure.
Figure 15:
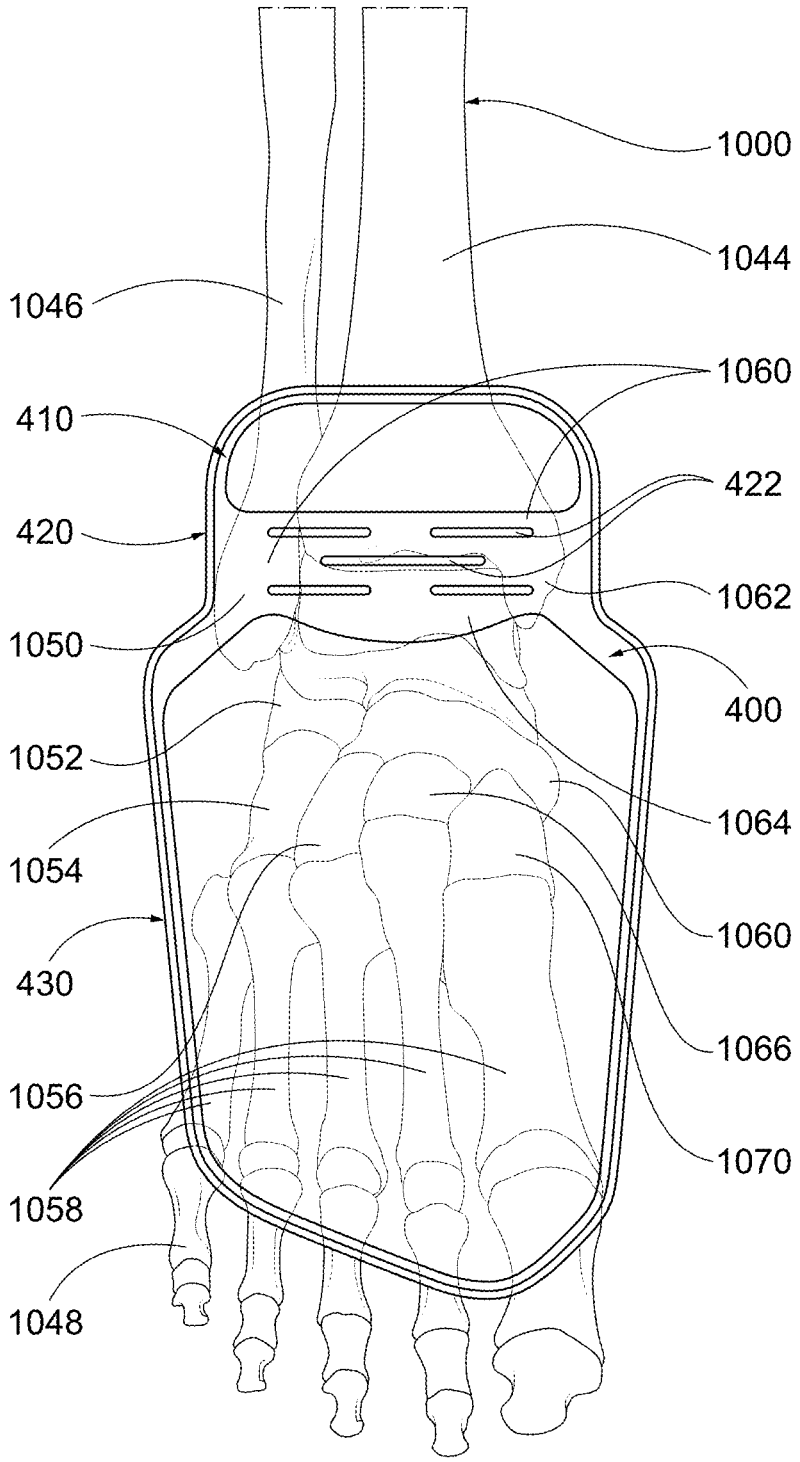
FIG. 15 is a front view of a dorsum guard overlayed over the muscular anatomy of a foot and a lower extremity, in accordance with an example of the disclosure.

The dorsum guard 400 may comprise a curvature that extends the dorsum guard 400 forward of the front 210 of the shin guard 200, from the bottom side of the shin guard 200, to cover the top of a practitioner's foot, or dorsum. The dorsum guard 400 may be adjustable at a top region 410 (as illustrated by FIG. 2), wherein the top region 410 (as illustrated by FIG. 2) of the dorsum guard 400 is adhered to the back 220 of the shin guard 200. The front 412 of the top region 410 of the dorsum guard may comprise the means for adhering the dorsum guard 400 to the back 220 of the shin guard 200. Further, the dorsum guard 400 may flex as it extends from the shin guard 200, thereby allowing the dorsum guard 400 to move with the foot in use. An intermediate region 420 (as illustrated by FIG. 2), between the top region 410 (as illustrated by FIG. 2) and a bottom region 430 of the dorsum guard, may comprise a thinner and/or more flexible fabric or material than the top region 410 and/or the bottom region 430. This allows the dorsum guard 400 to move freely relative to the shin guard 200 while being adhered to the shin guard 200. In other words, this allows the dorsum guard 400 to move in a different plane than the shin guard 200 while being adhered to the shin guard 200. The intermediate region 420 may further comprise one or more slots 422 (as illustrated by FIGS. 14-15), or serrations, to increase the flexibility at the intermediate region 420 while additionally providing limited protection to the ankle without impeding movement of the ankle. The bottom region 430 is positioned overtop the dorsum, or foot, of a practitioner and provides protection to the dorsum, or foot, of the practitioner. The bottom region 430 may comprise multiple layers wherein a top layer may be removed for replacement of the features of the dorsum guard 400. The layers may be secured to one another by hook and loop, mechanical fasteners, ties, or the like. The front 440 of the dorsum guard 400 may be convex and the back 450 of the dorsum guard 400 may be concave (as illustrated by FIG. 2), following the curvature of the dorsum, or foot, of the practitioner.

A strap 460 may further secure the dorsum guard 400 to practitioner's foot. The strap 460 may be a removable strap, removable from the dorsum guard 400. Apertures 462 may be provided in the fabric of the dorsum guard, such as in stitching 470, or seams, at the medial and lateral sides of the dorsum guard 400. The strap may be threaded through the apertures and adhered to itself by hook and loop, mechanical fasteners, ties, or the like. Additionally, or alternatively, the strap may be adhered directly to the dorsum guard 400 by hook and loop, mechanical fasteners, ties, or the like. The length of the strap 460 may be adjustable. The features of the front of the dorsum guard 400, as described above in view of FIG. 1, are additionally illustrated by FIG. 13, illustrating the dorsum guard 400 independent of (removed from) the shin guard 200 and the knee guard 300.

Additionally, or alternatively, the lower extremity combat training device 100 may further comprise an Achilles guard 600. The Achilles guard 600 may be a padded partial loop extending from the back 220 of the shin guard 200 from the padded medial side 240 to the padded lateral side 250. The Achilles guard 600 may be removable. In examples, the Achilles guard 600 may additionally extend into the calf region of a lower extremity. The Achilles guard 600 may be threaded through apertures in similar fashion as the strap 460 of the dorsum guard and adhered to itself by hook and loop, mechanical fasteners, ties, or the like. Additionally, or alternatively, the Achilles guard 600 may be adhered directly to the shin guard 200 (e.g., to the back 220 of the shin guard 200 through apertures) by hook and loop, mechanical fasteners, ties, or the like. The length of the Achilles guard 600 may be adjustable. In some examples, the Achilles guard may widen between padded medial side 240 and the padded lateral side 250. In one example, the Achilles guard may widen downwardly to additionally cover portions of a user's heel and or widen upwardly into the calf region. by example, this may be necessary for practicing heel kicks while additionally protecting a user's Achilles and/or calf.

Turning now to FIG. 2, the lower extremity combat training device 100 of FIG. 1 is illustrated from a back perspective view. As noted above, the back 220 of the shin guard 200 is concave with the padded medial side 240 and the padded lateral side 250 wrapping the back 220 as they extend from the centrally positioned pad 230 (illustrated by FIG. 1). FIG. 2 also illustrates the padded medial side 240 and the padded lateral side 250 extend above and about the shin guard 200 (as defined by the centrally positioned pad 230 as further illustrated by FIG. 1) into a knee guard 300 providing a medial side of the knee guard 340 and a lateral side of the knee guard 350, respectively. A perimeter stitching 272 extending about the shin guard 200 and the knee guard 300 connects a skin 260 of the front 210 of the shin guard 200, including a skin 360 of a front 320 of the knee guard 300, with a skin 262 of a back 220 of the shin guard, including a skin 362 of a back 322 of the knee guard 300. The perimeter stitching 272, in addition to the adjacent features as described in FIGS. 1-2, are further illustrated by a top side view of the lower extremity combat training device 100 of FIG. 5, a medial side view of the lower extremity combat training device 100 of FIG. 7, and a lateral side view of the lower extremity combat training device 100 of FIG. 8. A similar perimeter stitching 472, about the perimeter of the dorsum guard 400, is additionally illustrated by a bottom view of the lower extremity combat training device 100 of FIG. 6, in combination with adjoining features as otherwise described in view of FIGS. 1-2. Likewise, FIG. 7 illustrates a bottom view of the shin guard 200 of the lower extremity combat training device 100 with the dorsum guard 400 removed and in combination with adjoining features as otherwise described in view of FIGS. 1-2. Further yet, FIG. 12 illustrates a top view of the dorsum guard 400 of the lower extremity combat training device 100 removed from the shin guard 200 and in combination with adjoining features as otherwise described in view of FIGS. 1-2.

The skin 260 of the front of the shin guard 200 and/or the knee guard 300 may be of a different material than the skin 262 of the back 220 of the shin guard 200 and/or the back 322 of the knee guard 300. The front and back of the dorsum guard 400 may be similarly constructed. A padded knee cavity 310 comprising a fabric pouch 312 is further stitched between the medial side of the knee guard 340 and the lateral side of the knee guard 350. As explained above, the fabric pouch may encapsulate padding 314 of the padded knee cavity 310. The padded knee cavity 310 may be of yet another material such as, for example, a mesh material or fabric. The back 322 of the knee guard 300 is additionally concave, an extension of the back 220 of the shin guard 200. Further yet, the back 322 of the knee guard 300 is additionally concave at its top 324 in order to protect the top of the knee of the practitioner.

Figure 19:
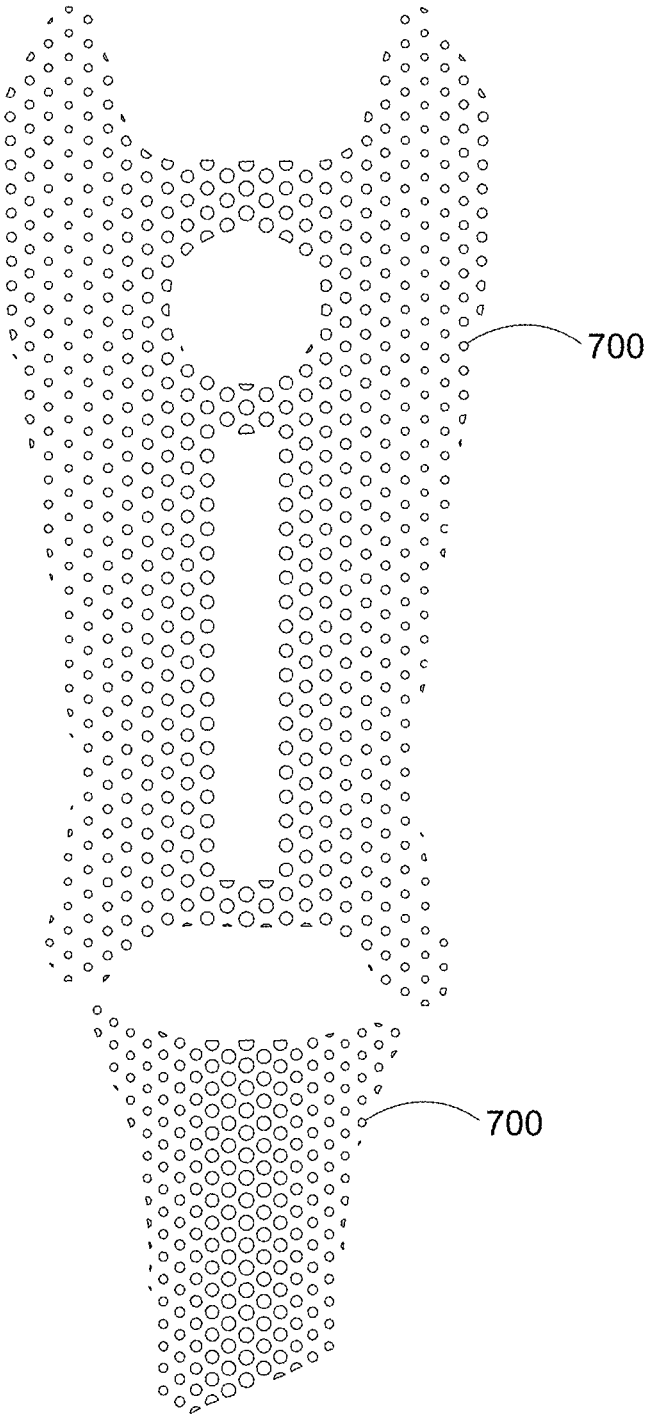
FIG. 19 is an example of the layout of silicon protrusions 700 for application to the back of a combat training device, in accordance with an example of the disclosure.

Turning to FIG. 4B, the back 220 of the shin guard 200 the back 322 of the knee guard 300, and/or the back 450 of the dorsum guard 400 may additionally comprise a layout of raised silicon protrusions 700, extending from skin 262, 362. The silicon protrusions 700 increase friction against a practitioner's lower extremity to prevent unintentional movement of the lower extremity combat training device 100 when in use. The silicon protrusions 700 may be stitched into, adhered to, attached to, etc. the skin 262, 362. The arrangement of the silicon protrusions 700 are selected based on degree of friction that is desired. An example of a layout of the silicon protrusions 700 is further illustrated by FIG. 19. In some examples, the entire back 220 of the shin guard and/or the entire back 322 of knee guard 300 may be silicon. As additionally illustrated by FIG. 4B, the back 450 of the dorsum guard 400 may be constructed in similar fashion as the shin guard 200 and/or the knee guard 300. Likewise, the back 450 of the dorsum guard may additionally comprise one or more silicon protrusions 700 and/or may be silicon. The silicon protrusions of FIGS. 4B and 19 are not illustrated by other FIGS. for the sake of clarity. It is, however, contemplated herein the silicon protrusions of FIGS. 4B and 19 may additionally form a part of the other FIGS. herein.

FIGS. 10A-10B further illustrate exploded perspective views of the features of FIGS. 1-2, respectively, and is labeled as described above in view of FIGS. 1-2. FIGS. 10A-10B further illustrates the removability and/or modular nature of many of the features otherwise described above.

Figure 16:
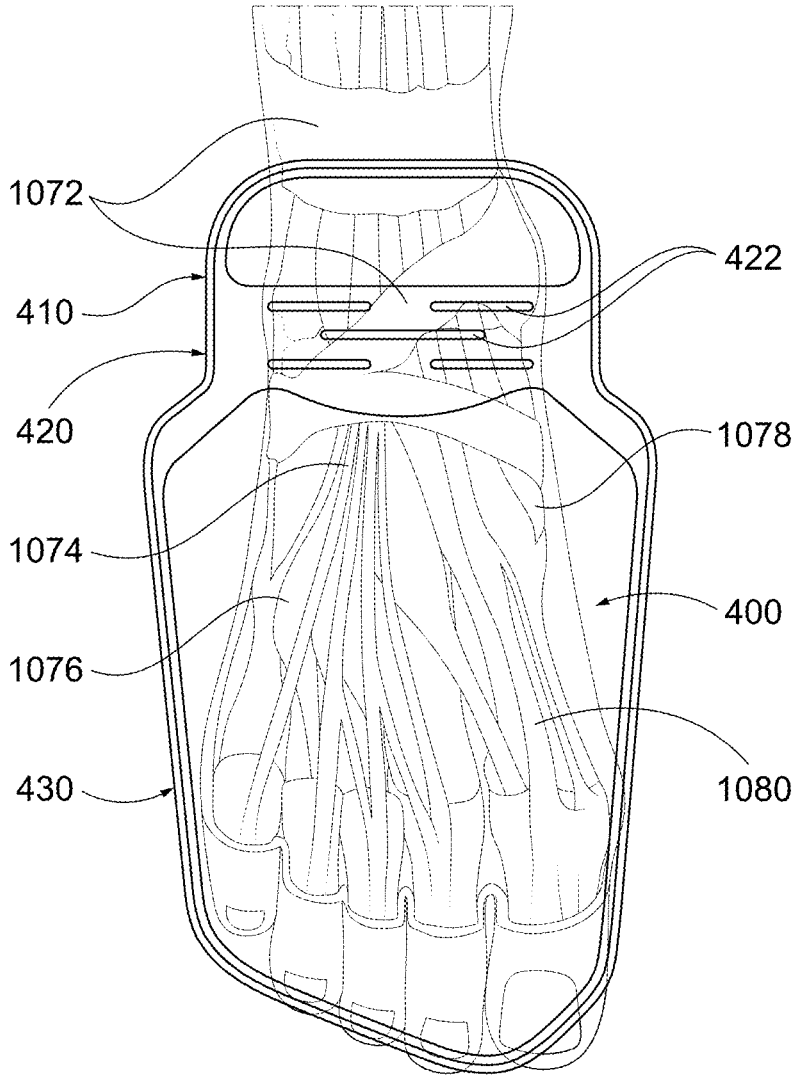
FIG. 16 is a front view of a lower extremity combat training device overlayed the muscular anatomy of a lower extremity, in accordance with an example of the disclosure.

FIGS. 14-16 further illustrate portions of the lower extremity combat training device 100 in view of protection afforded to the anatomy of a practitioner's lower extremity by illustrating the portions of the lower extremity combat training device overlayed over said anatomy. Specifically, FIG. 14 illustrates the lower extremity combat training device 100 provides significant protection to critical portions of the muscular and skeletal anatomy of a lower extremity 1000. Specifically, while protection is not afforded to the vastus medialis muscle 1002 or the rectus femoris tendon 1004, the lower extremity combat training device 100 adequately covers and protects the lateral patellar retinaculum 1006, the patella 1008, the patellar ligament 1010, the head of the fibula 1012, the tibial tuberosity 1014, the peroneus longus muscle 1016, the tibialis anterior muscle 1018, the extensor digitorum longus muscle 1020, the peroneus brevis muscle 1022, the extensor hallucis longus muscle 1024, the medial patellar retinaculum 1026, the sartorius tendon 1028, the gracilis tendon 1030, the semitendinosus tendon 1032, the pes anserinus 1034 (a combination of 1028, 1030, and 1032), the gastrocnemius muscle 1036, soleus muscle 1038, the superior extensor retinaculum 1040, and the inferior extensor retinaculum 1042. FIG. 15 further illustrates the dorsum guard 400, overlayed by the features of the dorsum guard 400 of the FIGS. above, partially protects the tibia 1044, fibula 1046, and phalanges 1048 and fully protects the lateral meniscus 1050, calcaneus 1052, cuboid 1054, lateral cuneiform 1056, metatarsals 1058, ankle mortise 1060, medial malleolus 1062, talus 1064, intermediate cuneiform 1066, navicular 1068, medial cuneiform 1070 of a skeletal anatomy of a foot. Finally, FIG. 16 additionally illustrates the dorsum guard 400, overlayed by features of the dorsum guard 400 of the FIGS. above, protects the extensor retinaculum 1072, the extensor digitorum 1074, the peroneus tertius tendon 1076, the tibialis anterior 1078, and the extensor hallucis longus 1080 of the anatomy of a foot.

While this invention has been described with reference to examples thereof, it shall be understood that such description is by way of illustration only and should not be construed as limiting the scope of the claimed examples. Accordingly, the scope and content of the examples are to be defined only by the terms of the following claims. Furthermore, it is understood that the features of any example discussed herein may be combined with one or more features of any one or more examples otherwise discussed or contemplated herein unless otherwise stated.

What is claimed is:

1. A lower extremity combat training device, the device comprising: a shin guard comprising a front and a back, the shin guard further comprising a centrally positioned pad extending from the front with a padded medial side and a padded lateral side extending from the centrally positioned pad, the padded medial side and the padded lateral side extending about the back wherein the back of the shin guard is concave; a knee guard that is an extension of the shin guard above the centrally positioned pad wherein the padded medial side is a medial side of the knee guard and the padded lateral side is a lateral side of the knee guard wherein the medial side of the knee guard and the lateral side of the knee guard extend continuously and unbroken from the shin guard and remain aligned with and move with the shin guard, the knee guard further comprising a padded knee cavity secured and framed between the medial side of the knee guard and the lateral side of the knee guard; and a dorsum guard adhered to the back of the shin guard below the centrally positioned pad, the dorsum guard capable of moving in a plane different than the plane of the shin guard, wherein a back of the dorsum guard is concave.

2. The device of claim 1, wherein the medial side of the knee guard and the lateral side of the knee guard are more rigid than the padded knee cavity wherein the padded knee cavity encapsulates a flexible pad comprising one or more slots which laterally open and close and are drawn closed by the padded knee cavity, drawn open when opposing pressure is applied, and return to being drawn closed when the opposing pressure is removed, wherein the flexible pad floats freely within the padded knee cavity and is not adhered to a material of the padded knee cavity.

3. The device of claim 1, wherein the flexible pad further comprises one or more serrations extending from a top side of the flexible pad opposite the shin guard.

4. The device of claim 3, wherein the one or more serrations are drawn closed within the padded knee cavity.

5. The device of claim 1, wherein a top side of the padded knee cavity comprises a curvature extending about and overtop of the back of the shin guard.

6. The device of claim 1, wherein a back of the padded knee cavity is a different material than the back of the shin guard and the back of the padded knee cavity is a mesh.

7. The device of claim 1, wherein the knee guard does not have a strap extending therefrom.

8. The device of claim 1 further comprising one or more straps and all of the one or more straps are below the knee guard.

9. The device of claim 1 further comprising a comfort strip interrupting the concavity of the back of the shin guard.

10. The device of claim 1, wherein the padded lateral side comprises more padding than the padded medial side.

11. The device of claim 1, wherein the padded lateral side is larger than the padded medial side.

12. The device of claim 1 that is asymmetrical about a central axis extending from the knee guard to the dorsum guard.

13. The device of claim 1 further comprising an Achilles guard, the Achilles guard is a padded partial loop extending from the back of the shin guard from the padded medial side to the padded lateral side wherein the Achilles guard is removable.

14. The device of claim 1, wherein the dorsum guard further comprises a strap extending across the back of the dorsum guard and the strap of the dorsum guard is removable.

15. The device of claim 14, wherein the strap of the dorsum guard is adjustable in length and adjustable in a direction along a central axis extending from the knee guard to the dorsum guard.

16. The device of claim 1, wherein the dorsum guard is adhered to the shin guard by a padded fabric adhered between the shin guard and the dorsum guard by a hook and loop arrangement.

17. The device of claim 16, wherein the padded fabric comprises a pattern of raised silicon protrusions.

18. The device of claim 16, wherein the dorsum guard adhered to the shin guard provides additional padding to the back of the shin guard.

19. The device of claim 1, wherein the back of the shin guard comprises a pattern of raised silicon protrusions.

* * * * *